US005977694A

United States Patent [19]

McGuire

[11] Patent Number: 5,977,694

[45] **Date of Patent: *Nov. 2, 1999**

[54] APERTURED DAYLIGHT LAMP

[75] Inventor: Kevin P. McGuire, Rochester, N.Y.

[73] Assignee: Tailored Lighting Inc., Rochester, N.Y.

[ * ] Notice: This patent is subject to a terminal disclaimer.

[21] Appl. No.: 08/923,563

[22] Filed: Sep. 4, 1997

Related U.S. Application Data

[63] Continuation-in-part of application No. 08/606,645, Feb. 27, 1996, Pat. No. 5,666,017, which is a continuation-in-part of application No. 08/291,168, Aug. 16, 1994, Pat. No. 5,569,983, which is a continuation-in-part of application No. 08/216,495, Mar. 22, 1994, Pat. No. 5,418,419.

[51] Int. Cl.[6] ..... H01J 5/16

[52] U.S. Cl. ..... 313/110; 313/112; 313/113; 362/293; 362/361

[58] Field of Search ..... 313/110, 112, 313/113, 117; 359/359; 362/293, 321, 351, 360, 361

[56] References Cited

U.S. PATENT DOCUMENTS

| | | | |
|---|---|---|---|
| 4,642,514 | 2/1987 | English et al. | 313/111 |
| 4,870,318 | 9/1989 | Csayni et al. | 313/113 |
| 5,666,017 | 9/1997 | McGuire | 313/110 |

*Primary Examiner*—Sandra O'Shea
*Assistant Examiner*—Michael J. Smith
*Attorney, Agent, or Firm*—Howard J. Greenwald

[57] ABSTRACT

A lamp for producing a spectral light distribution which is substantially identical in uniformity to the spectral light distribution of a desired daylight throughout the entire visible light spectrum from about 380 to about 780 nanometers. The lamp contains a lamp envelope comprised of an exterior surface, a light-producing element substantially centrally disposed within said lamp envelope, a reflector around the light-producing element, and an aperture assembly in front of the light-producing element.

20 Claims, 23 Drawing Sheets

| Volts | ft-candles 314* | ft-candles 312* | ft-candles 310* | deg-K 314* | deg-K 312* | deg-k 310* |
|---|---|---|---|---|---|---|
| 0 | 1 | 1 | 2 | 4500 | 4500 | |
| 10 | 1 | 1 | 2 | 4550 | | |
| 20 | 1 | 2 | 2 | 4600 | | |
| 30 | 1 | 2 | 2 | 4600 | | 4500 |
| 40 | 1 | 2 | 2 | 4600 | 2320 | 4400 |
| 50 | 10 | 18 | 8 | 3840 | 2320 | 2770 |
| 60 | 38 | 54 | 24 | 4700 | 2320 | 2890 |
| 70 | 92 | 118 | 56 | 5500 | 2320 | 3120 |
| 80 | 172 | 215 | 99 | 6300 | 2520 | 3320 |
| 90 | 293 | 350 | 163 | 7200 | 2630 | 3530 |
| 100 | 450 | 529 | 245 | 8350 | 2730 | 3730 |
| 110 | 628 | 753 | 343 | 9700 | 2840 | 3920 |
| 120 | 861 | 1043 | 476 | 11500 | 2920 | 4100 |
| 130 | 1140 | 1376 | 630 | 15000 | 3010 | 4300 |
| 140 | 1350 | 1643 | 762 | 17000 | 3060 | |

FIG. 15 (A)

15A
15B

| Cond. Angle | ft-candles 314* | ft-candles 312* | ft-candles 310* | deg-K 314* | deg-K 312* | deg-k 310* |
|---|---|---|---|---|---|---|
| 30 | 2 | 2 | 1 | 4350 | 3430 | 3860 |
| 40 | 5 | 8 | 3 | 3620 | 2500 | 3100 |
| 50 | 20 | 28 | 10 | 4000 | 2180 | 2800 |
| 60 | 60 | 64 | 28 | 4800 | 2250 | 2940 |
| 70 | 140 | 151 | 64 | 5300 | 2360 | 3190 |
| 80 | 250 | 269 | 115 | 5950 | 2470 | 3400 |
| 90 | 365 | 410 | 185 | 7100 | 2600 | 3610 |
| 100 | 510 | 512 | 250 | 7800 | 2650 | 3770 |
| 110 | 636 | 675 | 308 | 8750 | 2730 | 3870 |
| 120 | 785 | 775 | 370 | 9500 | 2770 | 3950 |
| 130 | 868 | 896 | 418 | 10000 | 2800 | 4050 |
| 140 | 923 | 950 | 444 | 10500 | 2820 | 4100 |
| 150 | 930 | 970 | 450 | 11000 | 2822 | 4100 |
| 160 | 940 | 990 | 455 | 11000 | 2824 | 4100 |
| 170 | 950 | 1010 | 460 | 11000 | 2826 | 4100 |
| 180 | 960 | 1025 | 466 | 11000 | 2830 | 4100 |

* Light Source

FIG. 15(B)

15A
15B

350
+5V
16
366
373
375
C1
C2
VCC
74HC148
U1
A2
A1
A0
E0
GS
GND
E1
6
7
9
15
14
8
0
1
2
3
4
5
6
7
10
11
12
13
1
2
3
4
5
D
371
J1
368
370
372
MODJACK8F
380
10K
RP1
SW1
352
SW2
354
SW3
356
SW4
358
SW5
360
SW6
362
SW7
362
D

APERTURED DAYLIGHT LAMP

CROSS-REFERENCE TO RELATED PATENT APPLICATION

This application is a continuation-in-part of patent application U.S. Ser. No. 08/606,645, filed Feb. 27, 1996, U.S. Pat. No. 5,666,017, which in turn was a continuation-in-part of U.S. Ser. No. 08/291,168, filed Aug. 16, 1994, U.S. Pat. No. 5,569,983 which in turn was continuation-in-part of patent application U.S. Ser. No. 08/216,495, filed on Mar. 22, 1994, U.S. Pat No. 5,418,419.

FIELD OF THE INVENTION

An integral, apertured lamp for producing a daylight spectrum.

BACKGROUND OF THE INVENTION

Many attempts have been made to simulate natural daylight by artificial means. Some of the more successful devices for this purpose are described in U.S. pat. Nos. 5,079,683; 5,083,252; and 5,282,115. The entire disclosure of each of these United States patents is hereby incorporated by reference into this specification.

The daylight lamp assemblies described in the aforementioned patents, in addition to producing focused light, also produces a non-focused component of stray light which often is distracting. It is an object of this invention to provide a daylight lamp assembly which will produce a directed daylight beam with only a minimal amount of stray light.

SUMMARY OF THE INVENTION

In accordance with this invention, there is provided an apertured lamp for producing a spectral light distribution which is substantially identical in uniformity to the spectral light distribution of a desired daylight throughout the entire visible light spectrum from about 400 to about 700 nanometers. The lamp contains an aperture, a lamp envelope comprised of an exterior surface, a light-producing element substantially centrally disposed within said lamp envelope, and a coating.

The light-producing element, when excited by electrical energy, emits radiant energy at least throughout the entire visible spectrum with wavelengths from about 200 to about 2,000 nanometers at non-uniform levels of radiant energy across the visible spectrum. In excess of thirty percent of said radiant energy emitted by said element is produced at wavelengths in excess of 700 nanometers. The element has a color temperature of at least about 2,800 degrees Kelvin. The element has an exterior coated surface which is disposed at a distance of less than 8 centimeters from said lamp element.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 15 is a table of the data sets of conduction angles and their corresponding illuminance levels and color temperatures;

DESCRIPTION OF THE PREFERRED EMBODIMENTS

The first part of this specification will describe one preferred lamp unit which may be used in the claimed apparatus of this invention. The second part of this specification will describe one preferred electronic apparatus for producing a variable spectral output. The third part of this specification will describe another preferred embodiment of the lamp of this invention.

One Preferred Lamp of the Invention

Figure 1:
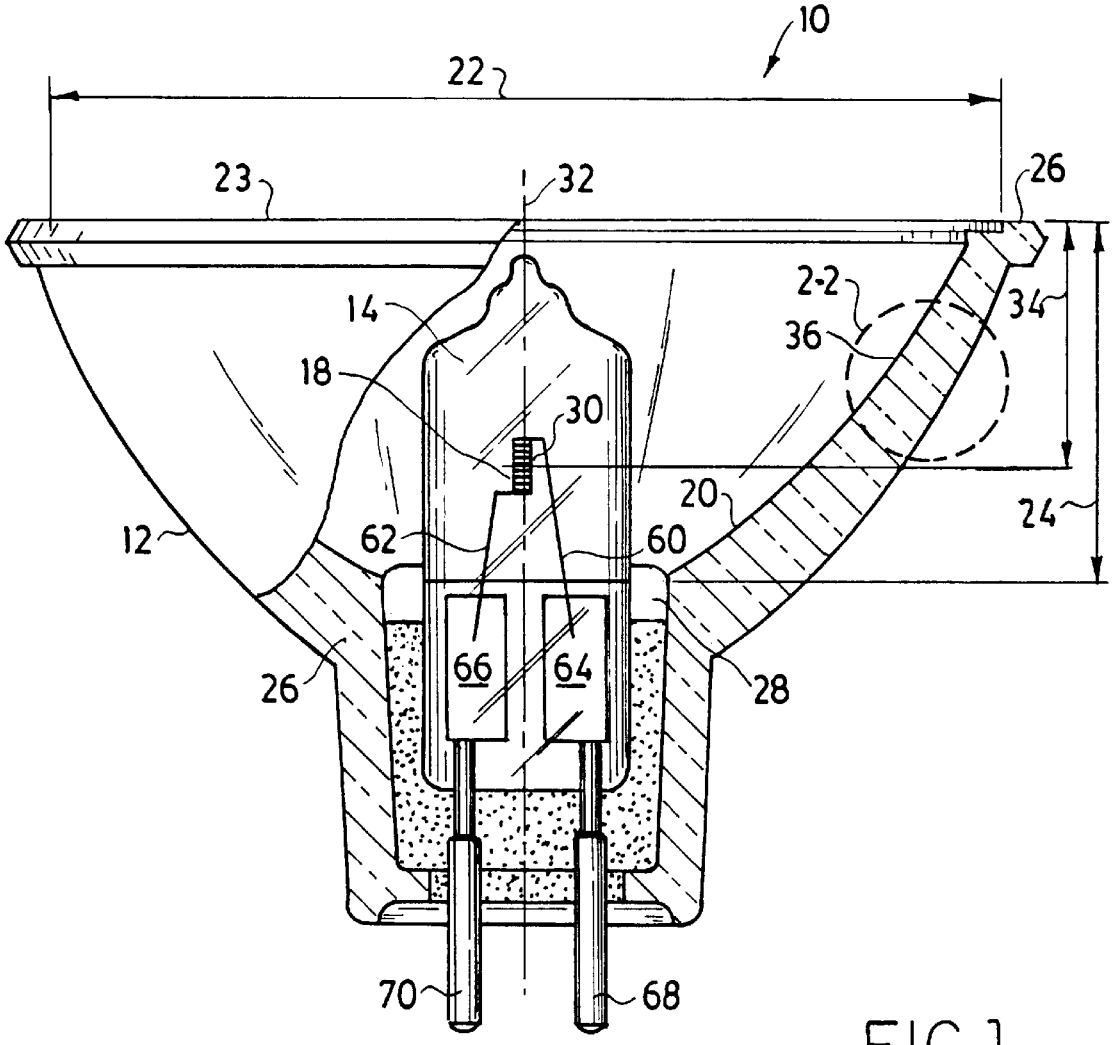
FIG. 1 is a sectional view of one preferred embodiment of a lamp assembly that can be used as part of this invention.

FIG. 1 illustrates one preferred lamp, lamp unit 10, of this invention. Unit 10 is described and claimed in U.S. Pat. No. 5,418,419, the entire disclosure of which is incorporated by reference into this specification.

Referring to FIG. 1, which is a sectional view, lamp and reflector unit 10 is comprised of a radiant energy reflector 12, an incandescent lamp bulb 14 secured and mounted in reflector 12 through the base 16 of reflector 12, and a filament 18 disposed within lamp bulb 14. Filament 18 is connected via wires 60 and 62 to electrical connecting tabs 64 and 66, and thence to pins 68 and 70, which may be plugged into an electrical socket, not shown.

The reflector used in the lamp of U.S. Pat. No. 5,418,419 has certain specified optical characteristics. In the first place, the reflector body has a surface which intercepts and reflects visible spectrum radiant energy in the range of 400 to 700 nanometers. The filament 18 of bulb 14 used in the co-pending application's lamp assembly is so positioned within the reflector so that at least about 60 percent but preferably at least about 90 percent of the visible spectrum radiant energy is directed towards the reflector surface.

Furthermore, the reflector body has a coating on its surface from which the reflected radiance of each wavelength of the visible spectrum radiant energy directed towards the reflector surface when combined with the visible spectrum radiant energy not directed towards the reflector surface produces a total light output in substantial accordance with the following formula discovered and first disclosed in U.S. Pat. No. 5,418,419:

$$R(1)=[D(1)-[S(1)\times(1-X)]]/[S(1)\times X],$$

wherein R(1) is the reflectance of the reflector coating for said wavelength, D(1) is the radiance of said wavelength for the daylight color temperature, S(1) is the total radiance of said filament at said wavelength, and X is the percentage of visible spectrum radiant energy directed towards said reflector surface.

The characteristics of reflector 12 are such that, on average, from about 80 to about 90 percent of all of the radiant energy with a wavelength between about 400 and 500 nanometers is reflected, on average, at least from about 50 to about 60 percent of all of the radiant energy with a wavelength between about 500 and 600 nanometers is reflected, on average at least about 40 to about 50 percent of all of the radiant energy with a wavelength between about 600 and 700 nanometers is reflected, and on average at least about 10 to about 20 percent of all of the radiant energy with a wavelength between about 700 and 800 nanometers is reflected.

As shown in FIG. 1, the lamp assembly filament 18 is located at focal point 30, which is preferably located substantially below top surface 26 of reflector 12 such that the distance 34 between focal point 30 and top surface 26 is at least about 50 percent of the depth 24 of reflector 12 and, more preferably, is at least about 60 percent of the depth 24 of reflector 12.

As will be apparent to those skilled in the art, as the depth 24 of reflector 12 increases, the reflector 12 will increase the percentage of visible spectrum radiant energy which is intercepted by the reflector surface. Referring to the formula R(1)=[D(1)−[S(1)×(1−X)]]/[S(1)×X], X will increase as the depth 24 of reflector 12 increases.

Figure 2:
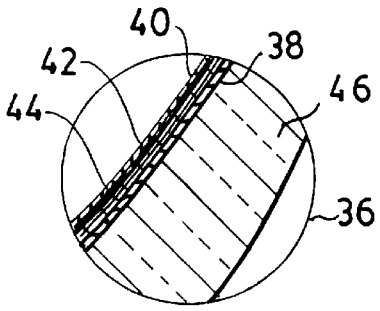
FIG. 2 is an enlarged sectional view of a portion of the reflector used in the assembly of FIG. 1.

Referring again to FIG. 1 and also to FIG. 2, it will be seen that filament 18 is a helical coil in shape with its longitudinal axis substantially aligned with and substantially parallel to axis of symmetry 32.

Reflecting surface 20 of reflector 12 is covered with a layer system 36 that is comprised of at least about five layers 38, 40, 42, and 44 which are coated upon substrate 46. Substrate 46 preferably consists essentially of a transparent material such as, e.g., plastic or glass. In one preferred embodiment, the substrate material is transparent borosilicate glass. As is known to those skilled in the art, borosilicate glass is a soda-lime glass containing approximately boric oxide which has a low expansion coefficient and a high softening point; it generally transmits ultraviolet light in higher wavelengths.

Although a minimum of at least about five such contiguous coatings must be deposited onto substrate 46, it is preferred to have at least twenty such contiguous coatings. In one preferred embodiment, each of layers 38, 40, 42, and 44 is a dielectric material (such as magnesium fluoride, silicon oxide, zinc sulfide, and the like) which has an index of refraction which differs from the index of refraction of any other layer adjacent and contiguous to such layer. In general, the indices of refraction of layers 38, 40, 42, and 44 range from about 1.3 to about 2.6. Each of the layers is deposited sequentially onto the reflector as by vapor deposition or other well know methods. It is preferred that, at different points on reflector 12, the thickness of the coatings system 36 varies and that such coating system 36 not have a uniform thickness across the entire surface of the reflector 12.

In accordance with the procedure described in U.S. Pat. No. 5,418,419, reflector 12 is produced with a specified spectral output. The spectral output is calculated and determined with reference to the spectra of daylight, the spectra of the specific type of bulb 14 used in the lamp 10, as well as the position of bulb 14 within the lamp 10 and the percentage of its emitted light directed toward the reflector.

Figure 3:
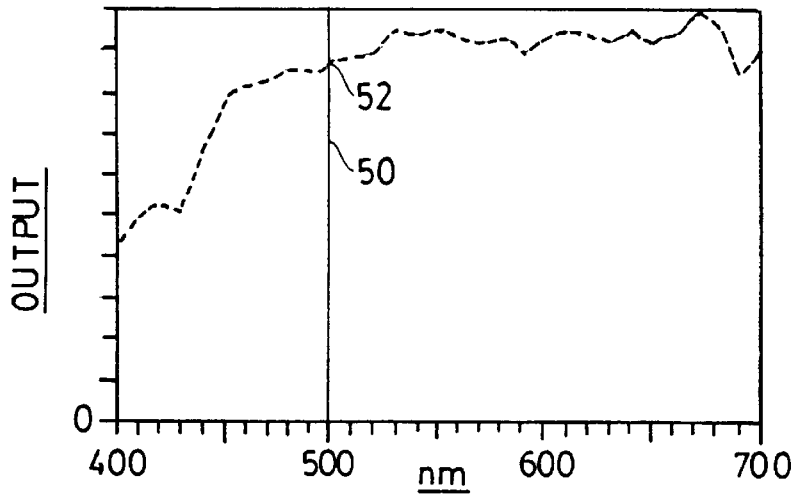
FIGS. 3, 4 and 5 are graphs, respectively, of an example of the spectra of daylight, an example of the spectral output of an incandescent lamp, and the reflectance of a reflector.
Figure 4:
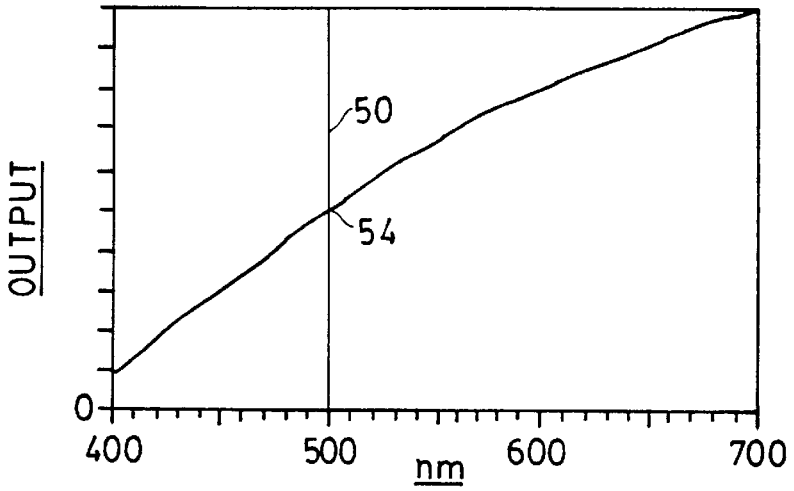

The spectra of daylight is well-known, and one example of such spectra is illustrated in FIG. 3. For any particular wavelength, the reflectance for reflector 12 at that wavelength can be determined for both the desired "daylight" and the characteristics of the lamp(s) used. Thus, referring to FIGS. 3 and 4, line 50 can be drawn at a wavelength of 500 nanometers to determine such radiances. Line 50 intersects the graph of the daylight spectra at point 52 and indicates that, at a wavelength of 500 nanometers, such daylight spectra has a radiance of 0.5 watts. Line 50 intersects the graph of the spectra of lamp 18 at point 54 and indicates that, at a wavelength of 500 nanometers, such lamp will have a radiance of 0.5 watts, assuming 100% of that wavelength of light that is emitted from the bulb is both directed toward and reflected by the reflector surfaces.

The reflector 12 is comprised of a reflector body with a coating on the surface of such body from which the reflected radiance of each wavelength of said visible spectrum radiant energy directed towards said reflector surface when combined with the visible spectrum radiant energy not directed towards said reflector surface produces a total light output in substantial accordance with the formula $R(1)=[D(1)-[S(1)\times(1-X)]]/[S(1)\times X]$, wherein R(1 is the reflectance of the reflector coating for said wavelength, D(1) is the radiance of said wavelength for the daylight color temperature, S(1) is the total radiance of said filament at said wavelength, and X is the percentage of visible spectrum radiant energy directed towards said reflector surface.

Figure 5:
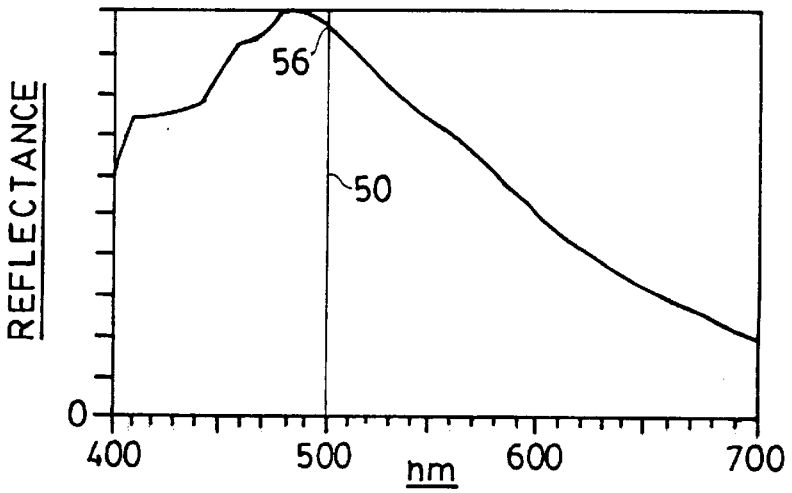

With the use of such formula, and for any particular wavelength, one can determine the desired reflectance for reflector 12. In the previous example, X=1 assuming 100% of the light is intercepted by the reflector, the equations simplified to $R(1)=[D(1)/S(1)]=0.5/0.5=100\%$. At the 500 nanometer wavelength this value may be plotted at point 56 (see FIG. 5).

By such a method, for each wavelength, a graph can be constructed showing the desired reflectance for the reflector 12. Such a typical graph is shown as FIG. 5. It will be appreciated that FIGS. 3, 4, and 5, and the data they contain, do not necessarily reflect real values but are shown merely to illustrate a method of constructing the desired values for the reflector 12.

By way of illustration and not limitation, and in accordance with the aforementioned method, the desired reflectance values for a parabolic reflector with a borosilicate substrate were calculated at various wavelengths and for various conditions.

For each such wavelength, the radiant exitance is measured and presented for the specified source. As is known to those skilled in the art, the radiant exitance is the radiant flux per unit area emitted from a surface. The spectral characteristics of each light source are also influenced by its filament coil design, type of gas and fill pressure.

There are many companies skilled in the art which, when presented with a set of desired reflectance values at specified wavelengths, the substrate to be used, and the dimensions of the desired reflector, can custom design a coating for a reflector which, when coated, will have the desired shape and size and produce the desired reflectance values. Thus, by way of illustration and not limitation, such companies include Action Research of Acton, Mass., Bausch & Lomb Corporation of Rochester, N.Y., Evaporated Coatings Inc. of Willow Grove, Melles Griot Company of Irvine, Calif., Pennsylvania, OCLI Company of Santa Rosa, Calif., and Tyrolift Company Inc. of West Babylon, N.Y.

As is known to those skilled in the art, a multiplicity of daylight spectra exist. What characterizes all of such spectra, however, is that each of them contain a relatively equal amount of all colors across the spectrum.

Figure 6:
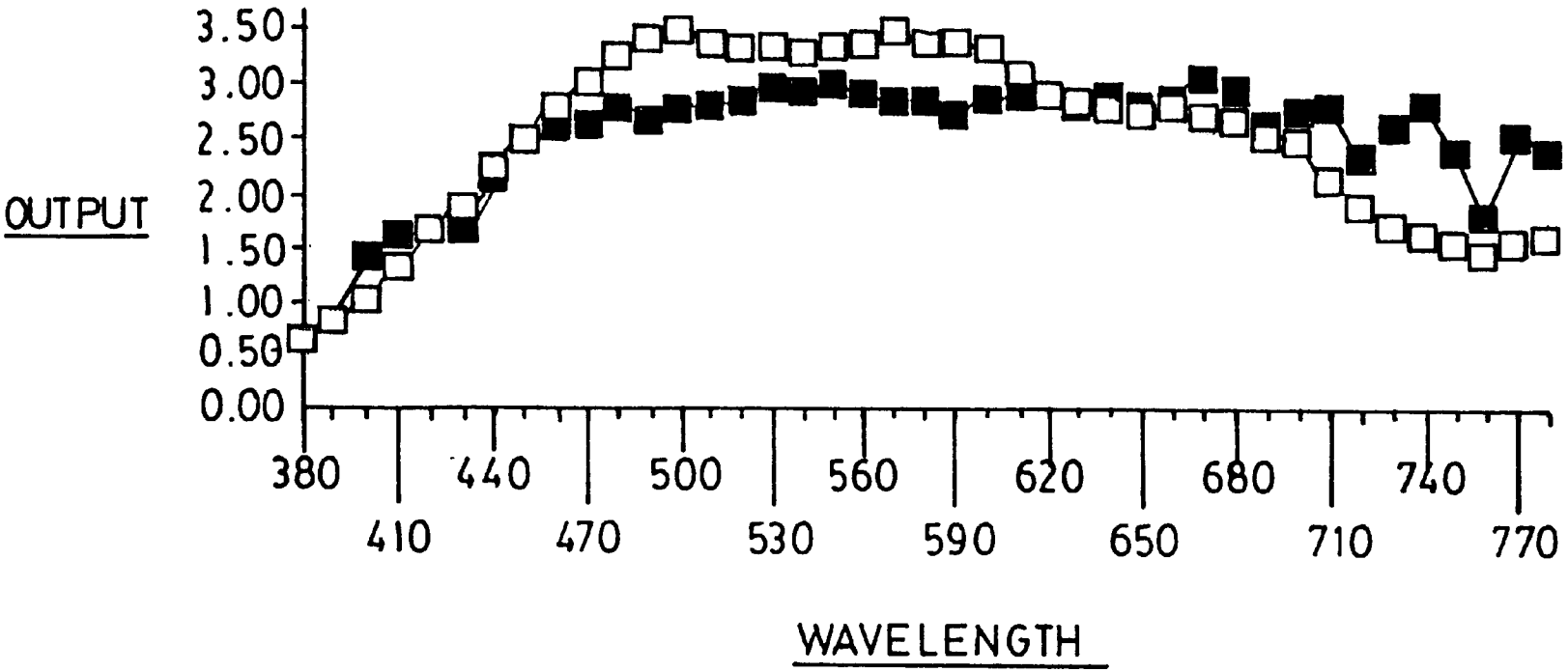
FIG. 6 is a graph of the actual output of a lamp assembly produced by copending application U.S. Ser. No. 08/216,495, as compared with actual daylight.

FIG. 6 is a graph of the output of a lamp assembly made with a reflector with the desired reflectance properties. For each wavelength, the output of daylight (black box value) and lamp 10 (white box value) were plotted. It will be noted that, across the spectrum, there is a substantial correlation between these values. The values are not identical, but they are substantially identical. Assuming at least a 90 percent of the visible light emitted from filament 18 is incident upon the reflector 12, the total light output of lamp 10 will comprise at least 50 percent of the visible light emitted by the filament 12.

As used in this specification, the term substantially identical refers to a total light output which, at each of the wavelengths between about 400 and 700 nanometers on a continuum, is within about 30 percent of the D(1) value determined by the aforementioned formula and wherein the combined average of all of said wavelengths is within about 10 percent of the combined D(1) of all of said wavelengths.

As will be apparent to those skilled in the art, an incandescent bulb may readily be produced with a specified filament and filament geometry by conventional means. Thus, e.g., one may use the method of U.S. Pat. Nos. 5,037,342 (quartz halogen lamp), 4,876,482 (a halogen incandescent lamp), and the like. It is preferred to orient filament 18 so that it is substantially parallel to the axis of rotation 32 of the reflector 12.

Bulb 14 preferably has a specified degree of illumination per watt of power used. It is preferred that, for each watt of power used, bulb 14 produce at least about 80 candelas of luminous intensity. As is known to those skilled in the art, a candela is one sixtieth the normal intensity of one square centimeter of a black body at the solidification temperature of platinum. A point source of one candela intensity radiates one lumen into a solid angle of one steradian.

Means for producing bulbs which provide at least about 80 candelas of luminous intensity per watt are well known to those skilled in the art. Thus, e.g., such bulbs may be produced to desired specifications by bulb manufacturers such as Sylvania Corporation.

It is preferred that the high-intensity bulb 14 be a high-intensity halogen bulb. Such high-intensity halogen light sources may be obtained from manufacturers such as Carley Lamps, Inc. of Torrance, Calif., Dolan-Jenner Industries, Inc. of Woburn, Mass., the General Electric Corporation of Cleveland, Ohio, Welch-Allyn Company of Skaneateles Falls, N.Y., and the like. Many other such manufacturers at listed on pages 467–468 of "The Photonics Buyers' Guide," Book 2, 37th International Edition, 1991 (Laurin Publishing Company, Inc., Berkshire Common, Pittsfield, Mass.).

Referring again to FIG. 1, lamp assembly 10 is preferably comprised of a circular cover slide 23 which consists essentially of transparent material such as, e.g., glass, to cover the entire open end of reflector 12. Cover slide 23 is preferably at least about 1.0 millimeter thick and may be attached to reflector 12 by conventional means such as, e.g., adhesive. The function of cover slide 23 is to prevent damage to a user in the unlikely event that lamp assembly 10 were to explode. Additionally, if desired, cover slide 23 may be coated and, in this case, may be also be used to filter ultraviolet radiation.

Figure 7:
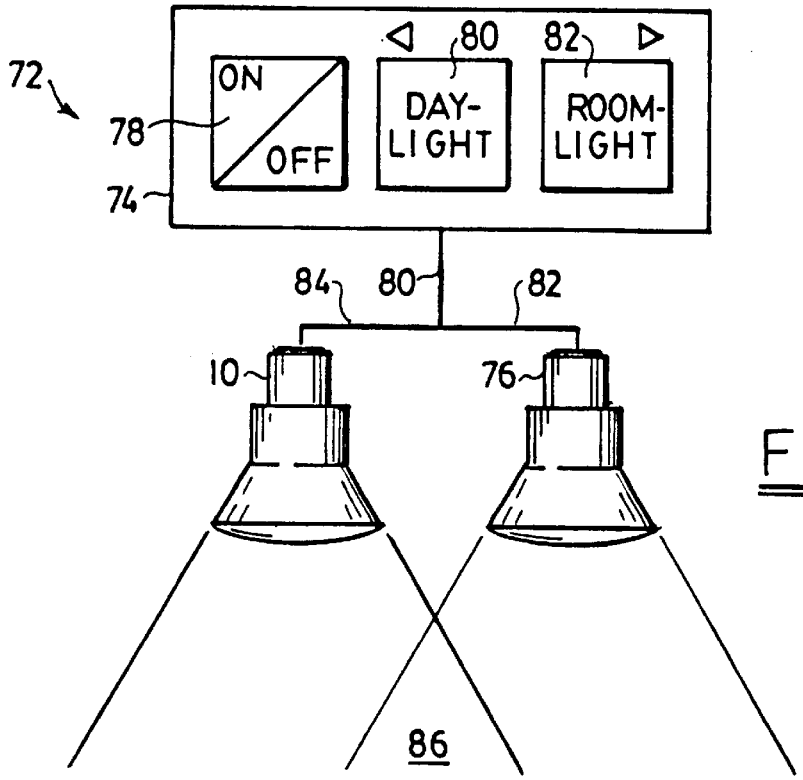
FIG. 7 is a schematic of a lighting assembly using the present invention.

FIG. 7 is a schematic representation of a lamp assembly using the instant invention. It will be seen that lamp assembly 72 is comprised of a controller 74 (to be described) which is electrically connected to both lamp 10 and lamp 76 by means of wires 80, 82, and 84.

Lamp 76 is preferably a standard incandescent lamp whose spectral output differs from that of lamp 10. These incandescent lamps are very well known to those skilled in the art and are described, e.g., in U.S. Pat. Nos. 5,177,396, 5,144,190, 4,315,186, 4,870,318, 4,998,038, and the like. The disclosure of each of these patents is hereby incorporated by reference into this specification. In one embodiment, incandescent bulb 76 is an MR-16 bulb sold by the Sylvania Company with a color temperature of approximately 3,200 degrees Kelvin.

Although only one lamp 10 and one lamp 76 are illustrated in FIG. 7, many such lamps may be connected to and controlled by controller 74. The function of controller 74, which will be described in detail later in this specification, is to vary the amount of energy, and the time when such energy is delivered, which is passed from it to each of lamps 10 and 76. Thus, e.g., controller 74 is equipped with an on—off switch 78 to turn lamps 10 and 76 on and off, a daylight "ramp-type" switch 80, and a room light (or indoor) ramp-type switch 82.

Figure 8:
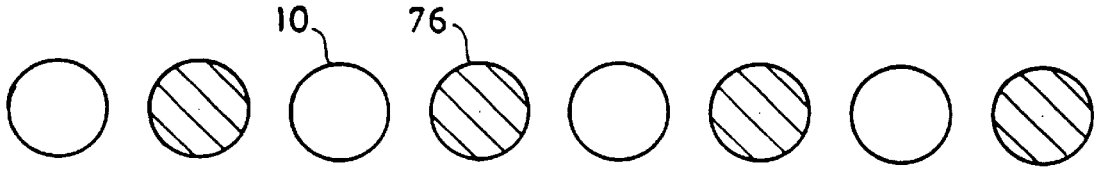
FIGS. 8 and 9 represent lighting assemblies comprised of multiple lamps in the assembly of FIG. 7.
Figure 9:
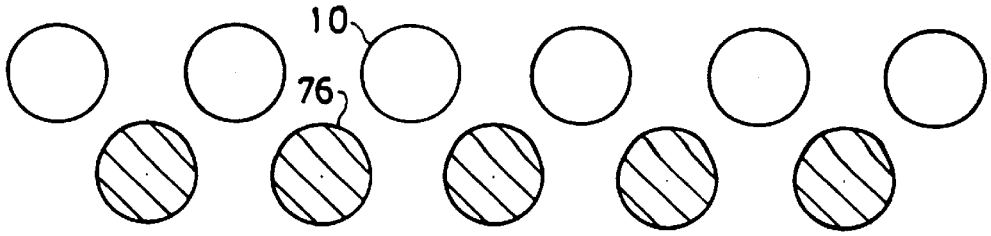

One arrangement of multiple lamps 10 and 76 is illustrated in FIG. 8, which comprises a dual-track low-voltage lighting system. Such lighting systems generally are well known to those skilled in the art. See, e.g., the Times Square Lighting catalog, which is published by the Sales and Manufacturing Division of Times Square Lighting, Industrial Park, Route 9W, Stony Point, N.Y. Another such arrangement of multiple lamps 10 and 76 is illustrated in FIG. 9, which comprises single track low-voltage lighting systems. Single track systems (see FIG. 9) are sold as products L002, L004, and L008 by this company. Dual track systems (see FIG. 8) are sold as products TS2002, TS2004, etc. by this company. Fixtures which can be used with either the single or dual track systems are sold Gimbal Rings (TL0121), Round Back Cylinders (TL0108), Cylinders (TL0312), Asteroid (TH0609), and the like.

A Preferred Lighting System of this Invention

Although U.S. Pat. No. 5,418,419 describes the use of prior art means for so controlling lamps 10 and 76, such as the means illustrated in U.S. Pat. Nos. 3,794,828, and 5,175,477, controller 74 of the invention of this application now will be described in full detail.

In one preferred embodiment, the lighting system of this invention is an electronic apparatus for producing a wide variety of spectral outputs. This apparatus is comprised of a first light source, a second, dissimilar light source, a source of alternating current, a means for specifying the desired spectral output and/or illuminance, electronic means for varying the alternating current delivered to the first light source to produce a first spectral output, and electronic means for varying the alternating current delivered to the second light source to produce a second spectral output.

In many respects, the lighting system of this patent application is similar to the lighting systems described in U.S. Pat. Nos. 5,079,683; 5,083,252; 5,282,115 and 5,329,435, the disclosure of each of which is hereby incorporated by reference into this specification. Each of the first two of these patents discloses an apparatus for continuously producing at least two spectrally different light distributions possessing substantially the same illuminance.

In U.S. Pat. No. 5,079,683, opto-mechanical means are provided for simultaneously varying the spectral distribution of light which passes through such means while maintaining the flux of such light at a substantially constant illuminance level. In U.S. Pat. No. 5,083,252, opto-mechanical means are disclosed for moving different optical filters in different directions, thereby changing the distance between such filters and the extent to which the filters interact with a beam of polychromatic light. In U.S. Pat. No. 5,282,115, an adjustable, opto-mechanical filter means comprised of a composite filter is provided. The apparatus of the present invention as illustrated by controller 74 contains precise electronic means for controlling the output of at least two spectrally different light sources to achieve light distributions of predetermined, combined illuminance and/or spectral output levels. The process by which this is done is illustrated in FIG. 10.

Figure 10:
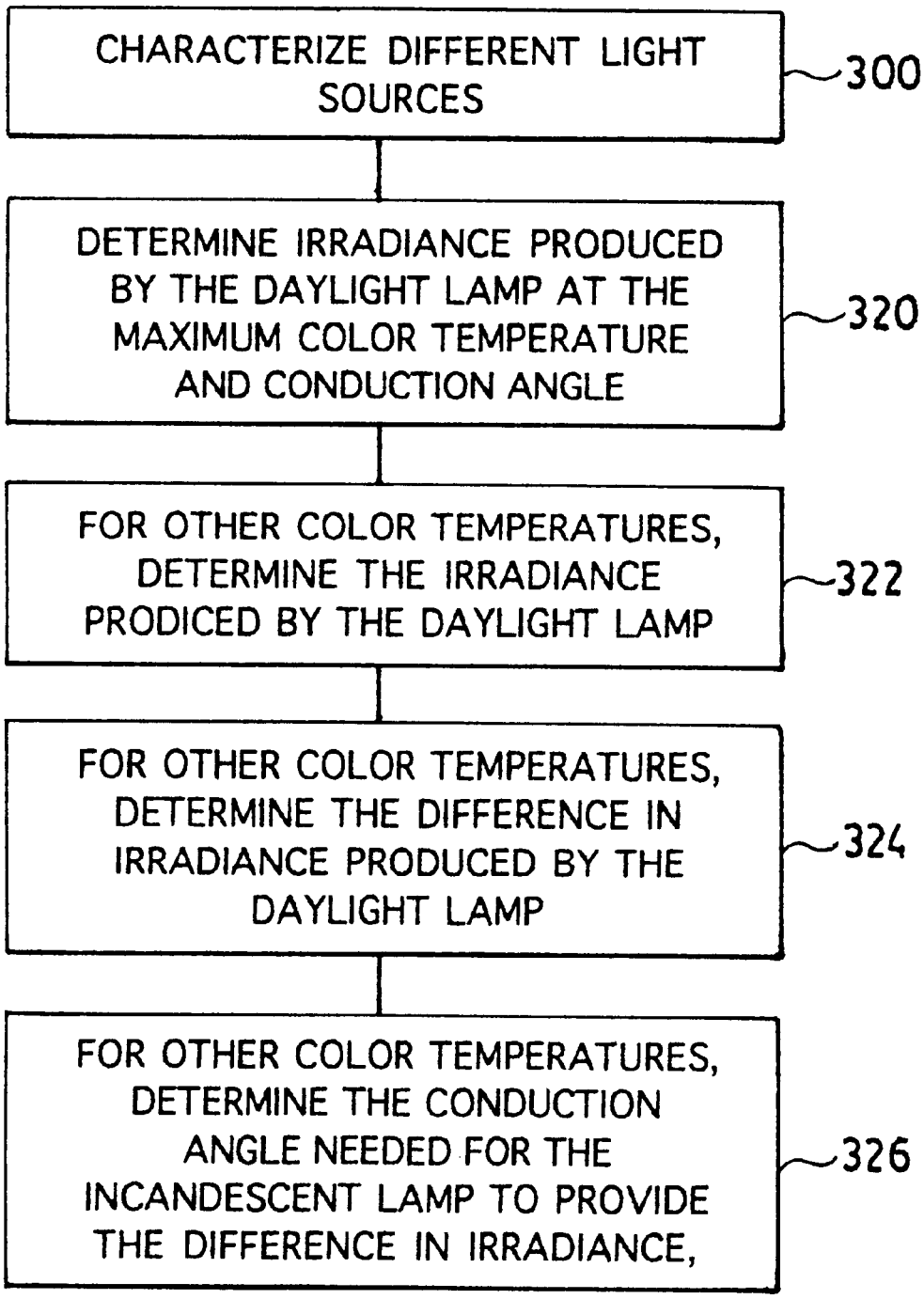
FIG. 10 is a flow diagram illustrating a preferred process for producing desired spectral outputs.

Referring to FIG. 10, and in the preferred embodiment illustrated therein, in step 300 of the process at least two different light sources (not shown) are characterized to determine their ranges of illuminance and color temperature values as will be described.

At least two of the light sources used in this process must be spectrally different. It is preferred that they have color temperatures which differ from each other by at least about 200 degrees Kelvin. Some of these light sources, and their optical parameters, are described in the aforementioned U.S. Pat. Nos. 5,079,683; 5,083,253; and 5,329,435 and in copending application U.S. Ser. No. 08/216,495.

In one preferred embodiment, the light sources used are full-spectrum, incandescent type of lamps. Thus, by way of illustration and not limitation, one may use a 150-watt, tungsten-halogen incandescent lamp as the lower temperature light source (which is available from MacBeth Corporation of Newburgh, N.Y. as catalog number 20120029) and, in addition, a 750-watt tungsten halogen incandescent lamp (available from MacBeth Corporation as catalog number 20120027), which becomes the higher temperature light source by interjection of a color correction filter (available, e.g., from MacBeth Corporation as catalog number 29003013). In the remainder of this specification, and for the sake of simplicity of description, the 150 watt lamp will be referred to as the incandescent source and the 750 watt lamp/color correction filter combination will be referred to as the daylight source. It will be apparent to those skilled in the art that many other combinations of light sources may be used in the apparatus of this invention as long as the color temperatures of such sources differ by at least about 200 degrees Kelvin. It is preferred that the daylight source have a color temperature of at least about 6,500 degrees Kelvin and, preferably, have a color temperature of from about 6,500 to about 8,000 degrees Kelvin. It is also preferred that the incandescent source have a color temperature of from about 2,100 to about 3,000 degrees Kelvin and, more preferably, from about 2,200 to about 2,400 degrees Kelvin.

Although reference has been made to two light sources, it will be apparent to those skilled in the art that three or more such light sources can be used. Additionally, or alternatively, one may use a multiplicity of light sources, one series of which is one type of lamp, and one series of which is another type of lamp. Other combinations and permutations of light sources will be apparent to those skilled in the art and are within the scope of this invention. The apparatus used in the process of this invention will provide phase control for such light sources and will deliver alternating voltage power to such sources at different conduction angles and delay angles, depending upon the color temperature desired. The first step in the process is to characterize each of such light sources to determine, for a given conduction angle, what its illuminance and its color temperature will be.

Means for determining the conduction angle of alternating circuits are well known to those skilled in the art. Thus, by means of illustration and not limitation, one may refer to U.S. Pat. No. 4,968,927. By using that technique according to this invention, one may connect an oscilloscope in parallel with a light source and determine the illuminance and color temperature of the light source for each conduction angle. This is illustrated in FIG. 11, which is a circuit that may be used to characterize a light source to be attached to the apparatus of this invention.

Figure 11:
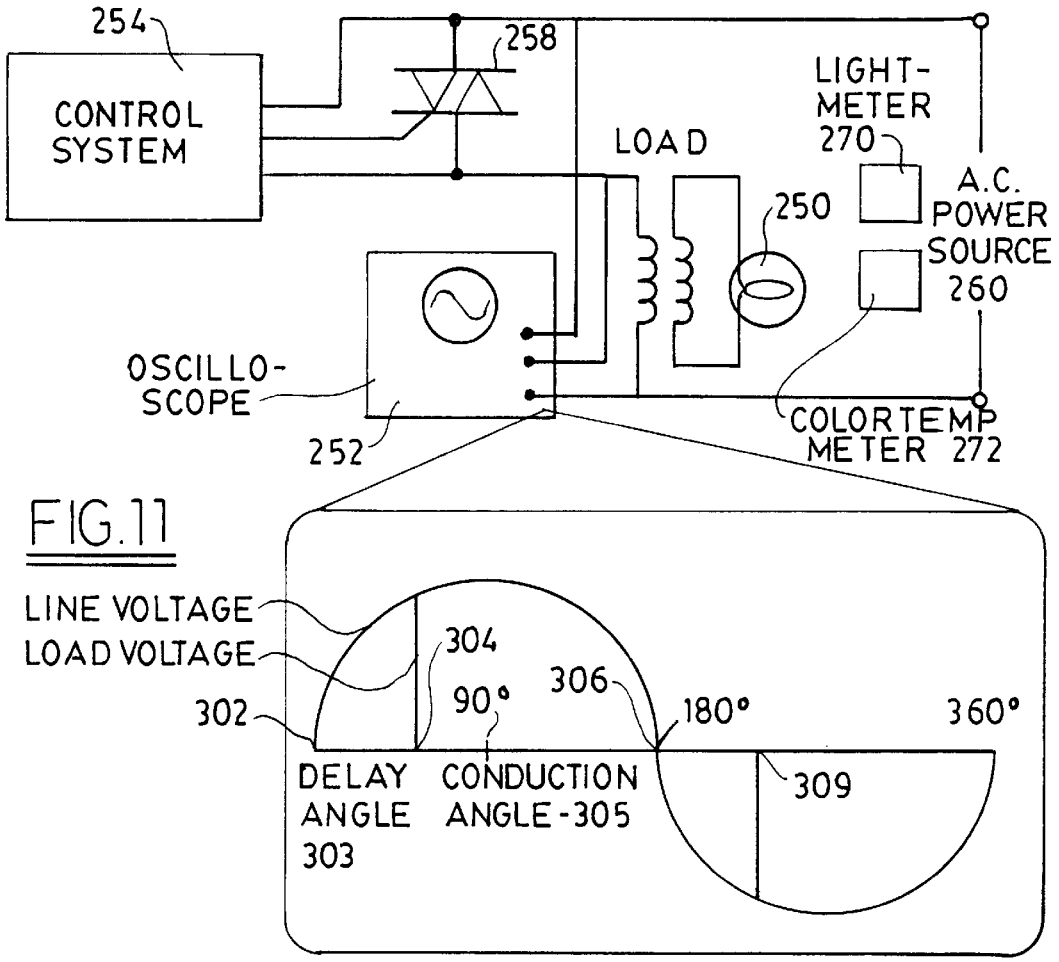
FIG. 11 is an oscilloscope circuit used to characterize, for any given light source, the delay angle and the conduction angle of applied voltage according to the invention to control the illuminance of the light source.

Referring to FIG. 11, the lamp 250 being characterized is connected in the circuit as the load to be measured by oscilloscope 252. A control system 254 as is known in the art controls thyristor 258 to cause a phase delay in voltage applied to the lamp load. It will be seen that, at point 302, although voltage from the alternating current power source 260 is being impressed across the circuit, current does not flow through the lamp 250 until a specified delay angle 303 has occurred. In the embodiment illustrated in FIG. 11, no current flows between points 302 (0 degrees) and 304 (30 degrees). Thus, in this example, the phase delay angle is 30 degrees. Details of the operation of the thyristor 258, phase control generally, and how effective voltage can be controlled can be found in well known reference texts, as for example THE THYRISTOR DATA MANUAL published by Motorola, Inc., copyright 1993 edition. See, for example, pages 1-2-8, 1-2-9, 1-2-15, and 1-3-14 through 17 of that publication.

The conduction angle 305 is equal to 180 degrees minus the phase delay angle and, in this example, is equal to 150 degrees; during this portion of the cycle, current flows through the light source (from points 304 to 306).

During the initial portion of the negative half of the voltage cycle (from points 306 to 309), current again does not flow through the light source; and, thus, the delay angle and the conduction angle for this negative half-cycle are 30 degrees and 150 degrees, respectively.

Figure 12:
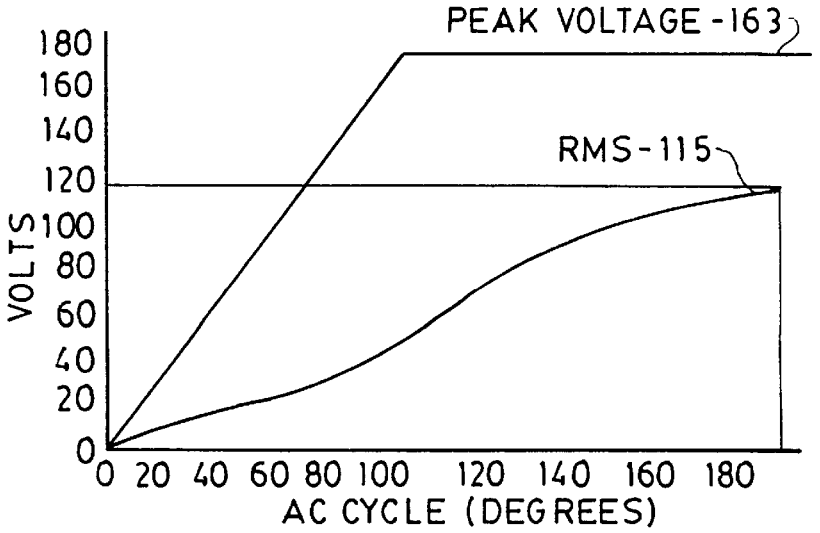
FIG. 12 shows the relationship of such angles with the Root Mean Square (RMS) value of the load voltage of FIG. 11.

As is known to those skilled in the art, the magnitude of an alternating current voltage is often refereed to as the magnitude of a direct current voltage that would produce the same heating effect. This is known as the Root Mean Square (RMS) of the alternating current voltage. FIG. 12 shows this relationship that exists between the conduction angle and the RMS value of the lamp load voltage of FIG. 11.

With changes in the conduction angle applied by the control system 254, since the RMS voltage is varied by the changes in the conduction angle, both the illuminance and color temperature of the light source will vary. Thus, one can determine, by using a light meter 270 that measures emitted light foot-candles and a color temperature meter 272 that measures the color of the emitted light in degrees Kelvin, both the illuminance levels and the color temperatures produced by a particular light source at various conduction angles within the voltage cycle can be read directly.

Figure 13:
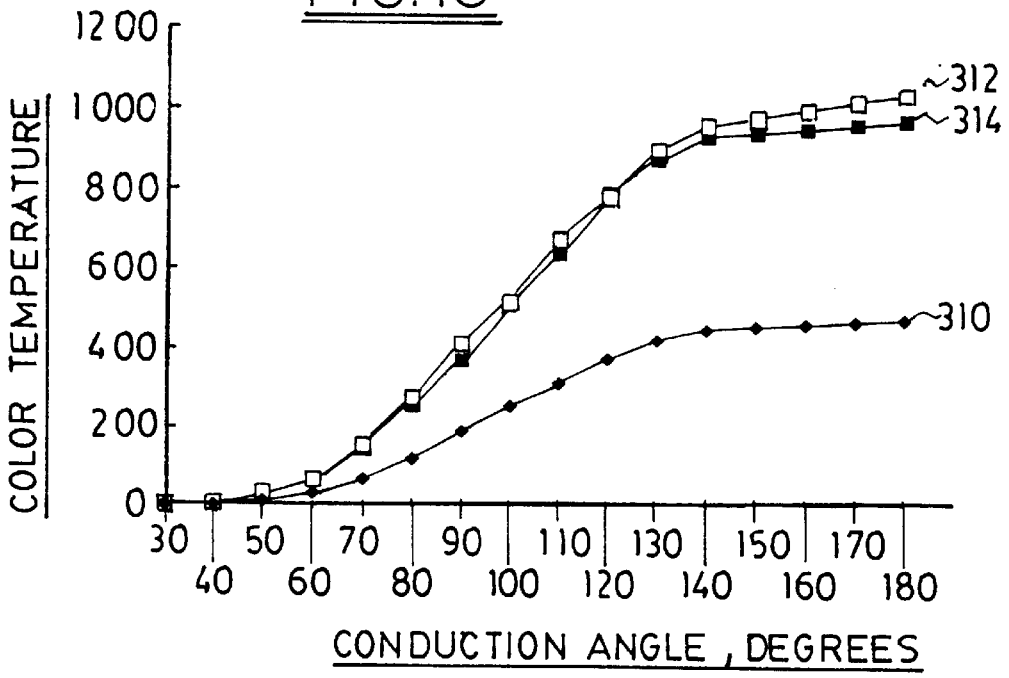
FIG. 13 is a graph of the illuminance of particular light sources, illustrating how it varies with the conduction angle of the voltage supplied to such light source.

FIG. 13 is a graph of the illuminances produced by three different light sources at different conduction angles. The three light sources evaluated were source 310 (the data for which is indicated by squares), source 312 (the data for which is indicated by circles), and source 314 (the data for which is indicated by crosses).

Figure 14:
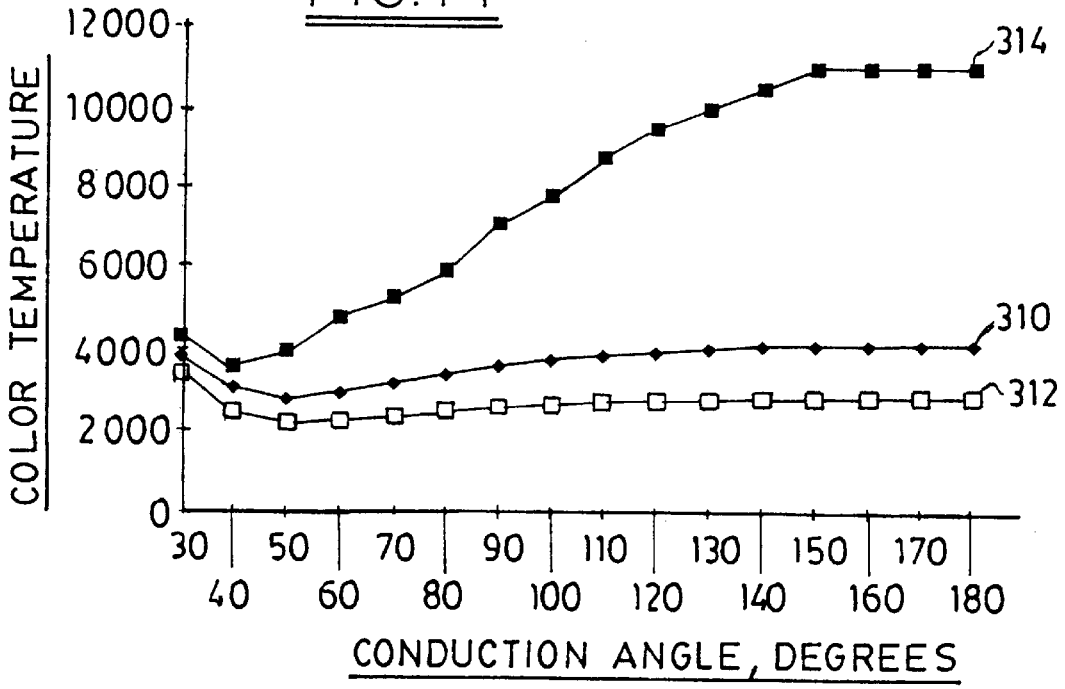
FIG. 14 is a graph of the color temperature of particular light sources, illustrating how it varies with the conduction angle of the voltage supplied to such light source.

FIG. 14 is a similar graph, illustrating the color temperatures for sources 310, 312, and 314 at different conduction angles. Using this data, tables such as that shown in FIG. 15 can be constructed correlating the conduction angles for a particular light source with both the illuminance of the source and its color temperature, which correlated data comprise data sets of delay or conduction angle/illuminance level/color temperature at each such measured angle. This is the process referred to in step 300 of FIG. 10.

Referring again to FIG. 10, in step 320, one then determines (by reference to the data generated for each light source), what conduction angle the "daylight" lamp should be supplied to provide the maximum desired color temperature for any particular application. As will be apparent to those skilled in the art, the daylight lamp is the lamp with the higher color temperature, and the number and/or sizes of the daylight lamps will determine the overall constant level of illuminance desired at that color temperature. In addition, the daylight lamp(s) may be capable of providing a color temperature even higher than the desired maximum by using a full conduction angle of 180 degrees, but for any given application a lower maximum may be desired.

In the next step of the process, step 322, one then determines (by reference to the portion of the table of data generated for that light source), the illuminance produced by the daylight lamp at color temperatures lower than the desired maximum color temperature and conduction angle.

For any color temperature lower than the desired maximum temperature, the illuminance produced by the daylight light source will be less than that at the maximum desired color temperature. Therefore, the other light source, or the incandescent lamp, will have to provide a finite amount of illuminance needed to make up the amount of illuminance lost by the daylight lamp because of its lower temperature output and smaller conduction angle. This difference in illuminance is determined in step 324.

The amount of illuminance needed from the incandescent lamp at any color temperature can be determined by reference to the tables (e.g., FIG. 15) and/or graphs (e.g., FIGS. 13 and 14). By referring to such data, one then can determine, in step 326, the conduction angle necessary to produce the desired amount of illumninance from the incandescent lamp at the specific color temperature. In addition, the overall color temperature of the combined light source can be read and added to the table or to a memory in the controller 74 by use of a feedback component as will be described so as to create a visual scale by which to set the conduction angles for any given composite color temperature.

A Preferred Controller for Use in the Lighting System

In the remainder of this specification, a preferred controller for use in the claimed lighting system will be described. This controller preferably comprises an input switching device, a power supply, a microcontroller (comprising inputs and outputs sufficient to detect and decode switch depressions, zero crossing, and option jumpers, and also sufficient to interface with non-volatile memory, a timer, an analog-to-digital converter with a four-channel multiplexer), an analog input circuit, non-volatile memory, switch output circuits, and lamp drivers.

In one preferred embodiment, one input to the microcontroller monitors 60 hertz power for zero crossings (which occur 120 times per second); the zero crossing is the time reference used for the phase delay angle and the conduction angle. Delaying the turn-on of the device by up to about 30 degrees has little effect on the intensity of most lamps. Delays between 30 and 150 degrees cause most lamps to dim. By 150 degrees most lamps are virtually dark, since delays between 150 and 180 degrees generally provide only about three percent of the total possible light. Of course, the invention can also be used in electrical systems other than 60 hertz, 110 volts alternating current, as for example the European standard of 50 Hertz, 220 volts AC, but the calculations would be based on other zero crossing frequencies and delay angles as appropriate, e.g. 100 zero crossings for a 50 hertz system.

The microcontroller's timer is started at the zero crossing. The frequency of the timer's clock is chosen to provide the required resolution between 30 degrees delay and 150 degrees delay. Thus, by way of illustration, to keep the timer value to eight bits, the number of clocks that the timer counts must be less than 256. There are preferably 120 degrees in the active control region (150 degrees minus 30 degrees). If the timer is restarted at 30 degrees, then the 120 degrees interval between 30 degrees and 150 degrees can be divided into 256 segments provided that the frequency of the timer clock is 46 kilohertz. The 8.33 milliseconds (the time it takes for one-half of the voltage cycle to occur) times 120/180 (the segment of the cycle during which current flows) divided by 256 (the number of desired segments) is equal to 21.7 microseconds, or 46 kilohertz.

Now the number of segments or steps that one wishes to ramp the lamps by their switches through the range of desired color temperatures is determined. Selection of the number of steps involves a compromise between the smoothness of transition between the color temperatures, the acceptable error in intensity and/or color temperature, and the amount of data and memory needed to accurately characterize and store the lamps over their full ranges. It is also important to insure that the time needed to make calculations and feedback adjustments can be provided for with the desired resolution.

Figure 16:
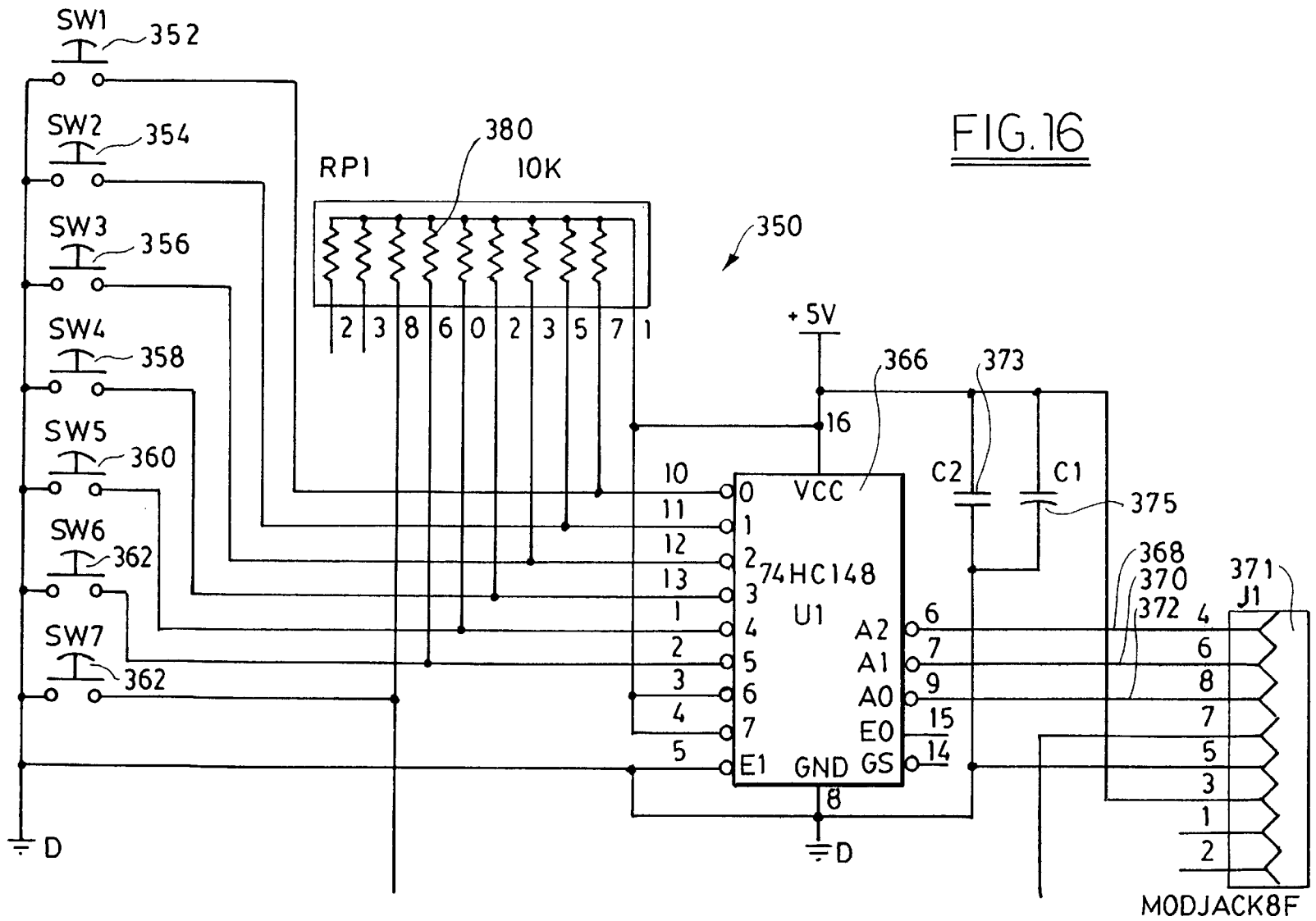
FIG. 16 is a schematic of an operator input device which may be used in conjunction with a preferred controller of this invention.
Figure 17:
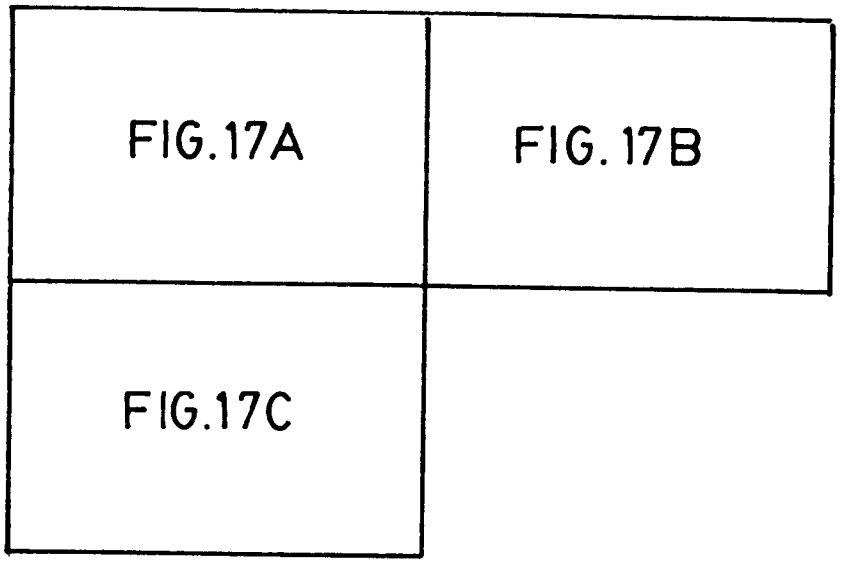
FIG. 17 is a schematic of a controller according to the invention, which will automatically adjust the power delivered to any two or more particular light sources to produce a spectral output of either constant illuminance and variable color temperature or constant color temperature and variable illuminance.
Figure 17A:
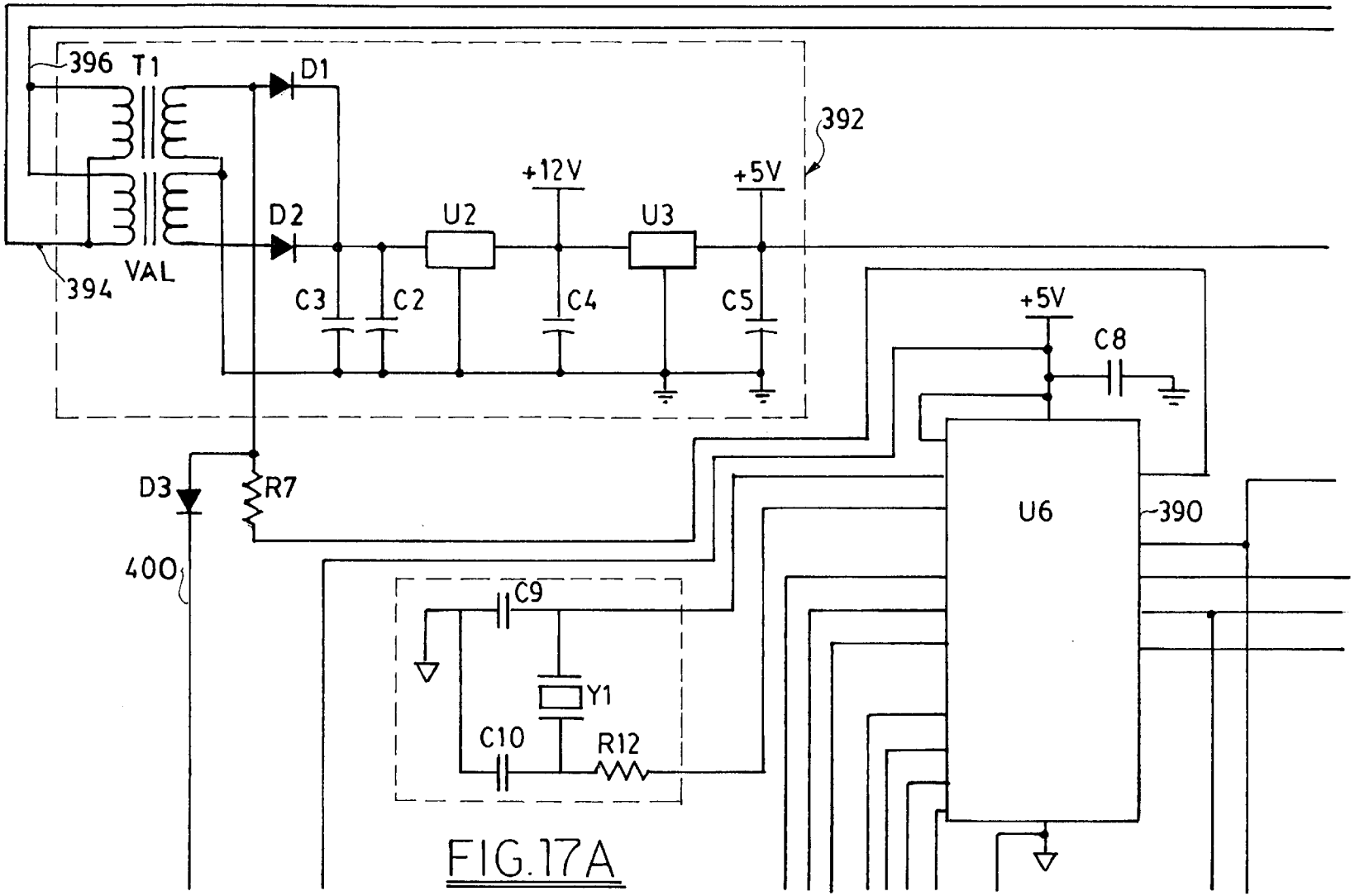
Figure 17B:
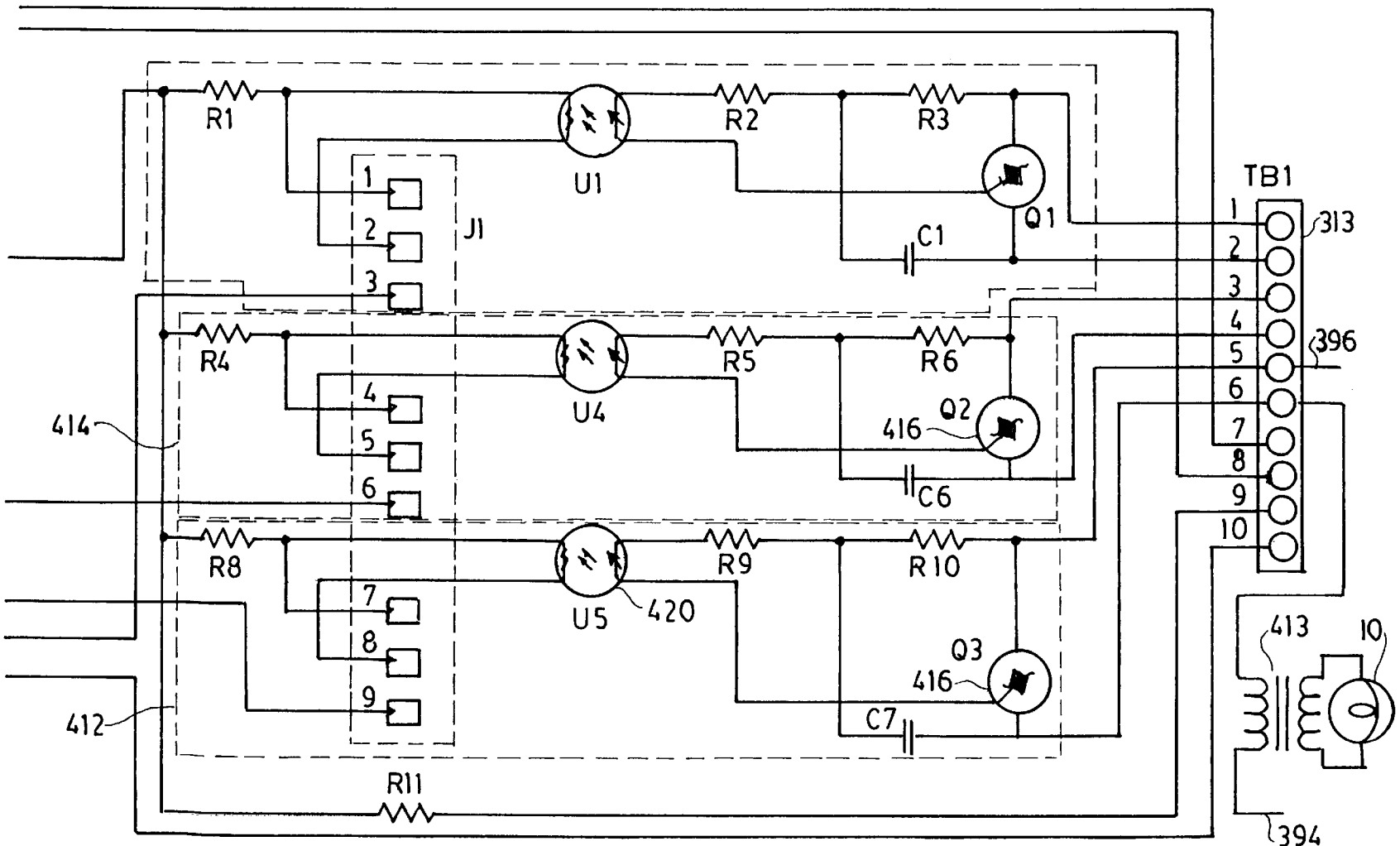
Figure 17C:
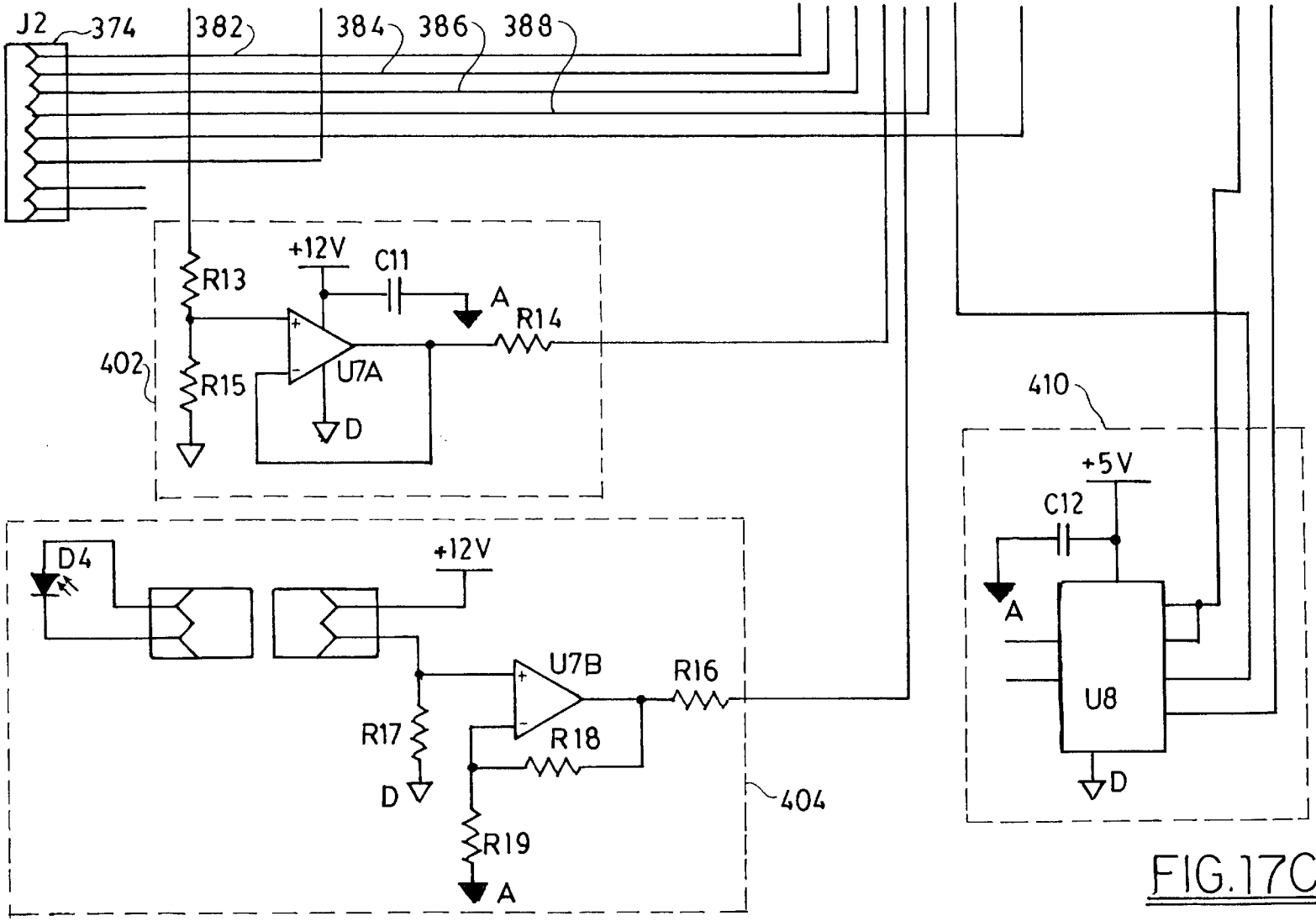

In the embodiment illustrated in FIGS. 16 and 17, a look-up table as in FIG. 15 was used to correlate the conduction angle of each lamp to the corresponding step of the ramp.

FIG. 16 is a schematic of one preferred input device 350 which may be used in the apparatus of this invention; in the preferred embodiment illustrated, input device 350 converts a key depression of any of the switches in the device into a three-bit digital code. As will be apparent to those skilled in the art, input device 350 by one or more of its switches allows a user to turn on or off one or more of the light sources in the lighting device. Additionally, input device 350 by others of its switches allows a user to vary the color temperature of at least a daylight light source and an incandescent light source. Furthermore, input device 350 has provisions to control other light sources in addition to the daylight light source and the incandescent light source, such as UV, cool white fluorescent, and/or "horizon" lights.

Referring to FIG. 16, it will be seen that input device 350 is comprised of a multiplicity of such switches 352, 354, 356, 358, 360, 362, and 364. Switches 352, 354, 356, 358, 360, and 362 are electrically connected to eight-line-to-three line priority encoder 366 which converts the input (key depression) from any one of such switches into a three-bit code and passes such code via lines 368, 370, and 372 to output jack 374. In the preferred embodiment shown, switch 352 represents the "on/off" button or switch, switch 354 represents the "daylight" button, switch 356 represents the "indoor" or "horizon" button, switch 358 the "CW" or cool-white fluorescent light bulb(s) switch, switch 360 the "UV" or ultraviolet light source, and switch 362 a "blank" switch available for future modifications to the apparatus. Each such input to priority encoder 366 has a corresponding resistor (see, e.g., resistor 380) to provide a signal when the switch to which it is connected is open.

Referring again to FIG. 16, capacitors 373 and 375 prevent the transmission of electrical noise to encoder chip 366. Switch 364 is an independent switch which is not connected encoder 366. This switch, representing the "store" switch and which is the functional equivalent of a shift key on a keyboard, may be used in conjunction with one or more of the other switches to calibrate the unit as will be described.

Referring to FIG. 17, the output from modular jack 374 is conveyed via lines 382, 384, 386, and 388 to microprocessor 390. Microprocessor 390 has several functions.

One function of microprocessor 390 is to decode the three-bit-digital code passed from modular jack 374 via lines 382, 384, 386, and 388. Software for performing this function will be described later in this specification.

Microprocessor 390 is connected to conventional power supply 392 which, in the embodiment illustrated, provides 12 volt direct current and 5 volt direct current to the circuit.

The input to power supply 392 is preferably 110 volt alternating current, which is fed to such power supply by lines 394 and 396. The alternating current voltage is stepped down to 12 volts in transformer 398, and the transformed 12 volt supply is then fed via line 400 to conditioning circuit 402, which scales the input voltage to a voltage level (generally about 5 volts peak alternating current) which can suitably be fed to microprocessor 390. In the preferred embodiment illustrated, the conditioning circuit 402 also provides an output impedance of about 10,000 ohms.

Referring again to FIG. 17, conditioning circuit 404 is also electrically connected to microprocessor 390 and is connected to light sensor 406 which measures foot-candles of light and is positioned within the apparatus to monitor the overall output of the lighting assembly. When the illuminance of the output sensed changes from the desired illuminance, the information is conveyed to microprocessor 390 which, in turn, adjusts the conduction angles of one or more of the light sources to correct the combined output illuminance and to restore it to its desired value. When the voltage of the input from light sensor 406 is too great for the microprocessor 390, circuit 404 will scale the input voltage to a level (usually about 5 volts peak alternating current) which the microprocessor 390 can safely handle.

Crystal oscillator assembly 408 provides the base frequency for the microprocessor 390.

Microprocessor 390 is also connected to nonvolatile memory circuit 410 which stores variable information regarding the light sources and their settings so that, when the power is turned off and on, the information is still available to microprocessor 390.

Referring again to FIG. 17, it will be seen that three lamp drivers are shown connected to microprocessor 390.

Lamp driver 412 is connected in series with a daylight lamp; and its output is conveyed via leads 5 and 6 to the daylight lamp, In the case of a lower voltage lamp such as lamp 10 described above, the driver is connected in series with the lamp's transformer 413 to step down the voltage from 110 volts AC to 12 volts AC. Lamp driver 414 is connected in series via leads 3 and 4 with the lower color temperature incandescent lamp or its transformer in the case of a lower voltage lamp.

In the preferred embodiment illustrated, each of the lamp drivers 412 and 414 is connected to microprocessor 390. Microprocessor 390 is connected to a conventional TRIAC opto-coupler 420 which is comprised of a light emitting diode and which, in response to the signal from the microprocessor, generates a light signal to activate the gate of the TRIAC and cause current to flow in the TRIAC 420. The output from opto-coupler 420 then is passed to TRIAC 416 (also referred to in this specification as thyristor 416). The thyristor 416 is operatively connected to lamp 10.

In the schematics of FIGS. 16 and 17, reference has been made using standard nomenclature to the electronic components of these preferred embodiments. The designations used are well known to those skilled in the art and are available from, e.g., in Newark Electronics catalog which was published by the Newark Electronics Company of Chicago, Ill. Reference also may be had, e.g., The Thyristor Data Manual published by Motorola, Inc., copyright 1993 edition of Tandy Electronics National Parts Division catalog published by Tandy Electronics of 900 E. North Side Drive, Fort Worth, Tex. More particularly, the microprocessor chip 390 and non-volatile memory 410 shown are available from Microchip Technology, Inc. of Chandler, Arizona, the opto-couplers 420 from the Motorola Corporation of Schaumberg, Ill., and the lamp drivers 418 from Teccor, Electronics, Inc. of Irving, Tex.

The program imbedded in the microprocessor according to the invention is developed with commonly available software tools, as for example assembly language to write source code, a compiler to convert the source code to object code, and conventional means to load the program onto the microprocessor control chip portion, which has random access memory to handle the calculations while the apparatus is in operation, non-volatile memory to remember the various settings when the apparatus is off or in standby as well as recalibration, and either a programmable read-only memory (PROM) to receive the operating program during manufacture of the apparatus or an erasable PROM to permit both initial loading and field changes of the operating program. The source code can easily be created by a computer programmer with normal skills in the programming art, once the operation of the apparatus as described above has been explained to the programmer. In essence, the operation would be based on key digital variables of the current switch settings as read from the nonvolatile memory, the base clock timer, a "debounce" timer to control voltage "bounce" that often is introduced when a switch is activated, a zero crossing bit for the alternating current lines to the lamps, the speed of the ramping of each of the illumination level switches to ramp up or down the illumination level of its corresponding light source incremented with the change in phase delay or conduction angle for that light source, a "scratch" location, a reading from the look-up table of the data sets of illuminance/color temperatures to match the ramping caused by pushing one of the light source switches, a reading of the desired INDEX for the other light source by calculating the necessary illumination component and determining the phase delay of the other light source by looking up the corresponding data set of illumination/color temperature for the other light source.

The program components themselves would contain a START to power up and initialize all variables, configure the I/O ports and the prescaler which scales the basic microprocessor clock to the desired counter frequency. The sequence would contain repeats at 120 times per second which begin by turning off all outputs, wait until the alternating current achieves zero crossing, start the timer, operate the switch routine by reading which switch is pushed to increment indexing to the lookup tables at a rate determined by the ramp timer, and get from the lookup tables the phase delays or conduction angles, and turn on the corresponding lamp as soon as the timer value is greater than the phase delay for that lamp.

The apparatus according to the invention may be constructed to provide both (1) a relatively constant illuminance while changing color temperature from a predetermined high point to a predetermined low point and (2) illuminance variations from a predetermined low point to a predetermined high point while maintaining the color temperature at a relatively fixed level. The general principle of this preferred embodiment of the invention is generally illustrated by the graph in FIG. 18 plotting foot candles of illuminance against degrees Kelvin of color temperature.

Figure 18:
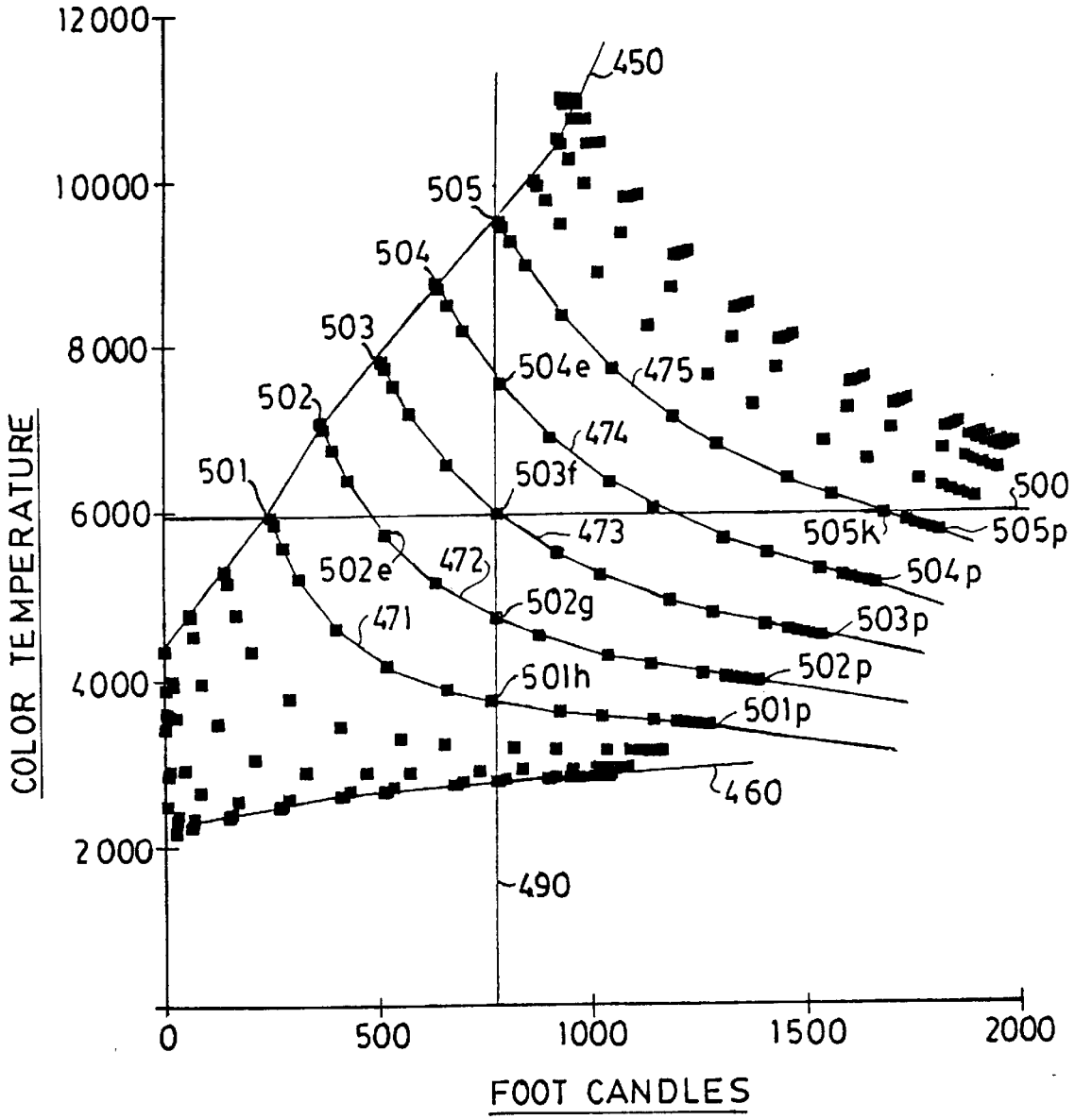
FIG. 18 is a another graph of characteristics oftwo light sources plotted to illustrate a method for programming a controller according to this invention in order to hold the color temperature relatively constant while varying the overall illuminance level.

FIG. 18 is a point plot of the light characteristics of the daylight lamp 314 (or group of such lamps) at sixteen (for simplicity) switch ramp stages at each of the conduction angles listed in FIG. 15, as shown by line curve 450 (the case when the incandescent lamp is off), the light characteristics of the incandescent lamp 312 (or group of such lamps) also at 16 switch ramp stages as shown by line curve 460 (the case when the daylight lamp is off), and all of the intermediate points of illuminance and color temperature of the combined light output of both lamps when both lamps are on at each of the different combinations of switch ramp stages (or conduction angles) for both lamps.

Referring again to FIG. 18, point 501 represents the light output when only the daylight lamp is on and its switch has been ramped to an intermediate position. Then at that daylight lamp output level, if the incandescent lamp is cycled through its ramp stages, the combined light output will be that shown by points 501*a* through 501*p* as shown by the curve 471 connecting those points. Similarly, as the ramping switch for the daylight lamp is moved to each of the successive stages 502 through 505, the corresponding curves of combined light output as the illumination of the incandescent lamp is increased is represented by the corresponding curves 472 through 475 connecting, respectively, points 502*a* through 502*p*, 503*a* though 503*p*, etc. For simplicity of illustration, only five such curves of light combinations are shown.

If the operating mode of relatively constant illuminance is selected, the appropriate switches (as will be described) are pressed to calibrate the apparatus for "constant illuminance" and set the non-volatile memory accordingly. The calibration mode will set the apparatus for the desired illuminance level using the daylight lamp, maximum desired color temperature, say at point 505 where the lamp is at 5900 oK, and for which the relatively constant level of illumination is indicated by line 490. Then as the ramping switch is pushed to reduce the color temperature, the microprocessor cycles the bulbs though the combinations of data sets of the two lamps as fall closest to line 490, i.e., 504*e*, 503*f*, 502*g*, etc.

If on the other hand a relatively constant color temperature is desired, the appropriate switches (as will be described) are pressed to calibrate the apparatus for "constant color" and then operate the switches described above in the calibration mode to achieve the color temperature level desired by turning on only the daylight source and increasing the conductance angle to increase the illumination and reading the output of the color temperature feedback sensor until the desired color temperature, for example 5950 oK as shown by line 500, is reached. This is shown at point 501 in FIG. 18 and represents the minimum illuminance level at that constant temperature. In order to maintain the relatively constant color temperature 500, the computer program determines that if the illumination level of the daylight lamp is increased from point 501 to 502, the conduction angle for the indoor lamp is increased from its zero step "a" to step "e" to point 502*e* in order to restore the color temperature to that on line 500, which process is repeated as the illumination level of the daylight lamp continues to be increased.

We also have discovered that each of the points of the graph of FIG. 18 can be represented, in mathematical terms, by their x-value in foot candles F of the sum of foot candles of each lamp, or Fdc+Fic', where Fid is the illuminance of the daylight lamp d at a specific conduction angle c, and Fic' the illuminance of the incandescent lamp i also at a specific but not necessarily same conduction angle c'. Correspondingly their y-value in oK is very closely approximated by the weighted average of the color temperatures of the two lamps as determined by:

$$[(Fdc)(oKdc)+(Fic')(oKic')]/[Fdc+Fic'],$$

where (Fdc)(oKdc) is the product of the color temperature oKdc of the daylight lamp at specific conduction angle c times the illuminance level Fdc, and (Fic')(oKic') is the product of the color temperature oKic' of the incandescent lamp times the illuminance level Fic' at specific conduction angle c'. These mathematical equivalents of course can be used to create the computer program outlined above.

In the normal mode of operation, the user ramps between predefined calibration limits with a resolution up to a maximum of the predefined conduction angle increments of, e.g., 30 steps. The calibration mode allows the user to set the operating limits of the apparatus for user operation between two predetermined end points: either (a) predetermined high and low color temperature points at a relatively constant level of illuminance or (b) predetermined low and high levels of illuminance at a relatively constant color temperature. The normal mode is entered by applying power with no push buttons depressed. Depressing the on/off switch 352 energizes the daylight and indoor lamps to produce the illuminance and color temperature at the level when the apparatus was last set. Depressing the daylight switch 354 or the indoor switch 356 causes the lamps to ramp along the characterized steps toward their high or low end points, respectively. Depressing the on/off button 352 after operation will cause the lamps to turn off but with the final setting remaining stored in the non-volatile memory so that upon pushing the on/off button 352 again to restart the apparatus in the operating mode, the lights will be powered at that last setting.

If supplemental light sources such as UV and/or cool white fluorescent lamps are used, the normal mode also allows for them to be separately energized by their switches 358 and 360.

To operate in a relatively constant illumination level, the calibration mode is entered by holding down the independent STORE button to activate switch 364 while the on/off switch 352 is pressed to turn the apparatus on. A separate light indicator or one of the lamps is programmed to temporarily flash to indicate that the apparatus is in its calibration mode. Depressing the daylight button 354 to ramp the daylight lamp from a zero conduction angle toward its full conduction angle while reading the illuminance light meter 406 will enable the operator to stop at a desired predetermined constant illuminance that is then stored in the non-volatile memory by again pushing the store button 364 and the indicator lamp temporarily flashed. This further shifts the apparatus by its program to connect both the daylight switch 354 and the indoor switch 356 to operate both the daylight and indoor lamps according to their data sets to change the color temperature along, for example, line 490 toward higher color temperature by pushing the daylight button and a lower color temperature by pushing the indoor button 356. When, for example, a desired high end point of color temperature is reached at point 504*e*, the store button 364 is again pushed to set this end point in the non-volatile memory, and again pushed when a low end point, for example at 501*h* in FIG. 18, to set that point in the non-volatile memory. The apparatus is then turned off and on again by pushing only the on/off button 352 to now enable the apparatus to be operated in its operating mode along line 490 between points 504*e* and 501*h*.

To calibrate the apparatus to operate in a relatively constant color temperature, the on/off switch 352 is activated while both the store button 364 and daylight switch 354 are depressed. to signal the program to operate the lamps accordingly. After the indicator lamp has flashed (twice if desired to distinguish this mode from the previously described calibration mode) to indicate the calibration mode has been entered, depressing the daylight switch then increases the conductance angle of the daylight lamp from zero toward its maximum along line 450 until the desired color temperature is read by the meter 406, for example at point 501 on FIG. 18. After temporarily depressing the store button 364 to set this value in the non-volatile memory, the program then sets daylight switch 354 and indoor switch 356 to operate both lamps from a minimum illuminance at point 501 toward a maximum illuminance along line 500 to, for example, point 505*k*. Pressing the store switch 364 again sets this limit in memory. The calibration mode is left by again depressing the on/off switch which will turn off all lamps to indicate that the calibration mode has been left. Upon restarting the apparatus by depressing only the on/off switch, the apparatus will then operate at a relatively constant color temperature along line 500 toward low illuminance end point 501 by pushing the daylight switch 354 and toward the high illuminance end point 505*k* by depressing the indoor switch 356.

All of the foregoing steps when described to a programmer with ordinary skill will be able to build upon the computer program outlined above to enable these operations to take place in the sequence described.

As suggested above, light sensor 406 is positioned not only to measure overall illuminance, but also may include a color temperature sensor as is well known in the art in order to provide to the user a direct reading of the color temperature either as a visual reference and/or to introduce the readings into the non-volatile memory of the microprocessor to supply the microprocessor with the color temperature readings to be used with the corresponding conduction angles in the data sets. Such a color temperature sensing device may be composed of two spectrally biased sensors, one detecting light primarily in the 400 nm to 500 nm portions (blue light) of the visible spectrum and the other sensor detecting light in the 700 nm to 780 nm range (red). Such two sensors as is well known in the art can be used to monitor the overall color temperature and foot candles of the combined light sources and the output of which can be used in the feedback circuit. Alternatively, light sensor 406 may use the photovoltaic system included in the MINOLTA XY1 light meter which normalizes the readings from three different light responsive cells each covering a portion of the visible light spectrum and which displays both illuminance and color temperature, but in lieu of a scaled meter readout the normalized analog voltage outputs are connected as feedback to the microcontroller and converted to digital information to be used as a reference to alter the phase angles as described above.

Thus, if the light source characteristics should change over time, or new lamps are inserted, or if a revised characteristics are preferred, the lamps can be recharacterized by the controller apparatus simply by programming in a scanning procedure that sequences the conduction angles of both lamps through all of their combinations and by the feedback light sensor 406 measuring both illuminance and color temperature at each such combination to reset the corresponding values in the look-up tables. One further can provide that the feedback circuit include the illumination level meter 406 in the operating mode, in addition to manual readout, to measure continuously the levels of illuminance and adjust the data sets accordingly, so that the effects of light source aging can be corrected in the tables without requiring recalibration.

It also is possible to use a point plot of two or more lamp types, as in FIG. 18, to design for others specific lighting systems with specific desired properties and limitations, for example by creating the plot using a finite number (two or more) of each lamp type and plotting all permutations of all lamp combinations at all conduction angle stages, applying an overlay of the desired high and low limits of illuminance and color temperature of the lighting system to be produced (which overlay may be rectilinear, oval or any other two dimensional shape), and then determining from the point plot which of the lamp combinations are needed to fill the desired light space.

In addition, if any supplemental light source such as the cool white fluorescent light source is included, its light output of course would also be read by the light sensor 406 and its computed value of illuminance read into the non-volatile memory to modify the data set values by a factor computed by the microprocessor to determine the finite amount of illuminance otherwise required by the incandescent indoor lamp to maintain the constant level of illuminance or color temperature, as desired.

Another Preferred Lamp of the Invention

Figure 19:
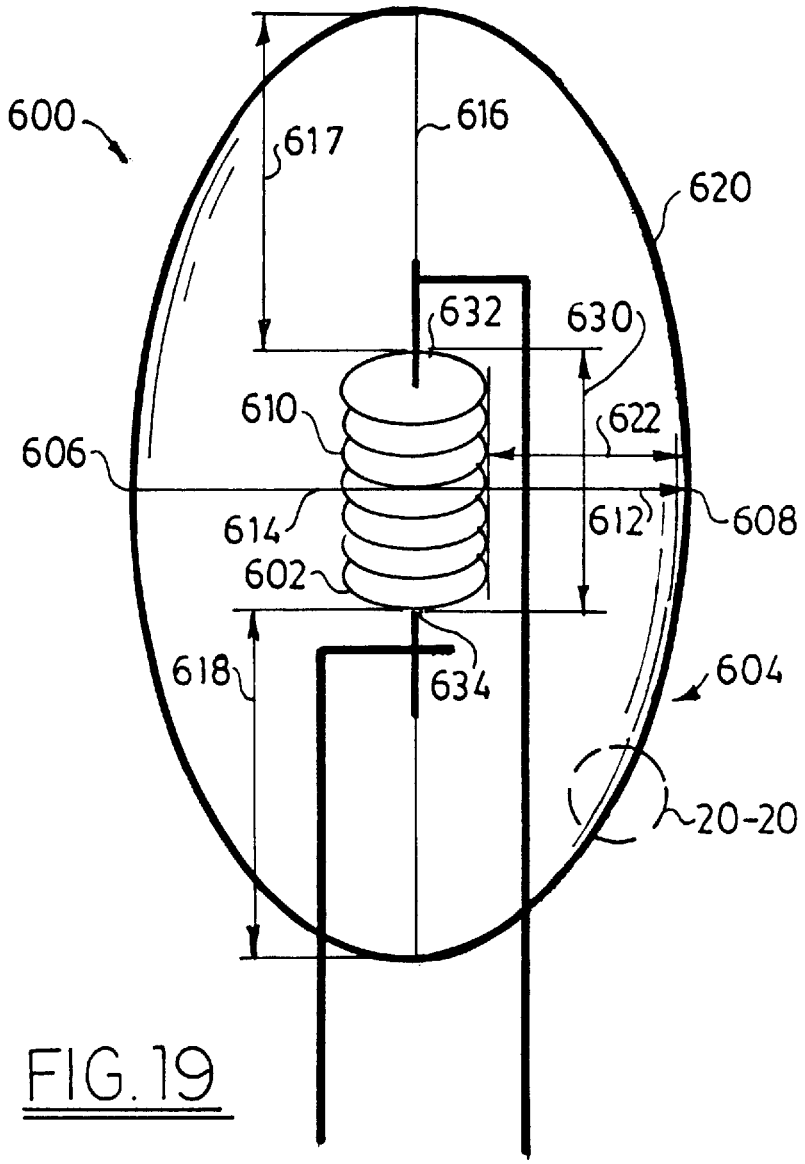
FIG. 19 is a sectional view of one preferred embodiment of the lamp of this invention.

FIG. 19 is a sectional view of a preferred lamp 600. Referring to FIG. 19, it will be seen that lamp 600 is comprised of filament 602 centrally disposed within lamp envelope 604.

As will be apparent to those skilled in the art, the filament 602 is the light-emitting element of lamp 600; and it will be referred to hereafter when discussing lamp 600. However, as will also be apparent to those skilled in the art, other light-emitting elements can be used in place of or in addition to filament 602.

Thus, by way of illustration, one may generate light by means of an anode-cathode arrangement such as those, e.g., shown in U.S. Pat. Nos. 5,394,047 (arc discharge lamp), 5,334,906, 5,270,615, 5,239,232 (light balance compensated mercury vapor and halogen high pressure discharge lamp), and the like. The disclosure of each of these patents is hereby incorporated by reference into this specification.

Lamps utilizing such anode-cathode arrangements are well known to those in the art and are commercially available. Thus, e.g., as is illustrated on page 563 of "The Photonics Buyers'Guide" Book 2, 37th International Edition, 1991 (Laurin Publishing Company, Inc., Berkshire Common, P.O. Box 4949, Pittsfield, Mass.), the Oriel Corporation (of 250 Long Beach Blvd., P.O. Box 872, Stratford, Conn.) sells a comprehensive line of light sources including arc, deuterium, quartz tungsten halogen, special calibration lamps, and infrared elements from 10 to 1,000 watts.

In the remainder of this specification, reference will be made to filament 602, it being understood that the comments made with reference to such filament are also applicable to other light-emitting means.

In the embodiment depicted in FIG. 19, filament 602 is centrally disposed within envelope 604 in both the X, Y, and Z directions. Thus, filament 602 is located substantially in the middle of walls 606 and 608 of lamp envelope 604.

If a point 610 is chosen on filament 602, and lines are drawn from such point perpendicularly to each of walls 606 and 608, the distance 612 between point 610 and wall 608 will be substantially equal to the distance 614 between point 610 and wall 606. In general, distance 612 will be from about 0.95 to about 1.05 times as great as distance 614.

Similarly, if a line 616 is drawn through the center of filament 602, the distance 617 from one end of filament 602 to the point at which line 616 intersects lamp envelope 604 is from about 0.95 to about 1.05 times as great as the distance 618 from the other end of filament 602 to a point at which line 616 intersects the opposite portion of lamp envelope 604.

The substantially centrally disposed position of filament 602 has been illustrated in FIG. 19 in the X and Y axis. Such illustration has not been made for the Z axis, for such three-dimensional depiction is not easy to illustrate. However, as those skilled in the art will recognize, the distances from the center of the filament to wall of the envelope, as measured in the Z axis, is also substantially equidistant, being from about 0.95 to about 1.05 as great as each other.

Referring again to FIG. 19, and in the preferred embodiment depicted therein, it will be seen that lamp envelope 604 preferably has a substantially elliptical shape.

Lamp envelopes with substantially elliptical shapes are well known to those skilled in the art. Thus, e.g., reference may be had to U.S. Pat. No. 5,418,420, which discloses a lamp with a concave elliptical shape; the disclosure of this patent is hereby incorporated by reference into this specification.

Reference also may be had to page 12–20 of the "Optics Guide 5" (Melles Griot, 1770 Kettering Street, Irvine, Calif., 1990). This page, which deals with ellipsoidal reflectors, discusses the origin, the primary focal point, the secondary focal point, the vertex, the height, and the width for a multiplicity of elliptical shapes where are suitable ellipsoid reflectors.

Referring to FIG. 19, and in the preferred embodiment depicted therein, it will be seen that filament 602 has a length 630 which is less than or equal to the distance between primary focal point 632 and secondary focal point 634.

In one embodiment, not shown, light emitting element 602 provides a substantially point-source of light which preferably is created with an anode-cathode arrangement. Thus, e.g., the ILC Technology Company of Sunnyvale, Calif. sells several "Cermax" lamps which provide substantially a point-source of light ". . . that can be easily focused to the smallest of spots".

When the light-emitting element used provides a substantially point-source of light, it is preferred that lamp envelope 604 have a cross-sectional shape which is substantially circular, and have a three-dimensional shape which is substantially spherical. As will be apparent to those skilled in the art, regardless of whether the elliptical or spherical shape is used, the geometry of lamp envelope 604 provides the maximum amount of reflectance back to light-emitting element 602 and thus provides more heat to element 602 to, in turn, generate more light.

In one preferred embodiment, at least about fifty percent of the infrared energy with a wavelength of from about 780 to about 2,000 nanometers which is emitted by light emitting source 602 is reflected back to element 602 by lamp envelope 604.

One means of insuring that a substantial amount of infrared energy is reflected back to light emitter 602 is to coat lamp envelope 604. Referring again to FIG. 19, it will be seen that lamp envelope 604 is preferably comprised of a coating 620.

In the embodiment depicted in FIG. 19, the coating 620 preferably extends over at least about 90 percent of the exterior surface of lamp envelope 604; and only one such coating is used. In another embodiment, not shown, lamp envelope 604 may contain two or more coatings.

Thus, for example, the coating or coatings used may be disposed on either the inside surface of lamp envelope 604, and/or its outside surface. Thus, e.g., one may dispose an infrared reflecting coating on the inside surface of lamp envelope 604, and a ultraviolet reflecting coating on the outside surface of lamp envelope 604; in this embodiment, the outside coating will transmit a selective portion of the visible light spectrum (see FIGS. 22–24, which will be discussed later in this specification).

Referring again to FIG. 19, and in the preferred embodiment depicted therein, it will be apparent that coating 620 may be deposited on lamp envelope 604 by conventional means. Thus, by way of illustration and not limitation, one may use the coating technology disclosed in U.S. Pat. No. 5,422,534, in which an optical interference filter is produced on a vitreous, light transmissive substrate. Thus, by way of further illustration, one may use the technology disclosed in U.S. Pat. No. 4,048,347, which describes a method of coating a lamp envelope with a heat reflecting filter. The disclosure of each of these United States patents is hereby incorporated by reference into this specification.

In one embodiment, not shown, the lamp envelope 604 is constructed of a material which, in and of itself, absorbs ultraviolet light. One material which can be used to make such a lamp is sold by the Corning Glass Works of Corning, N.Y. as "spectramax".

Referring again to FIG. 19, and in the preferred embodiment depicted therein, the maximum distance 622 between envelope 604 and filament 602 is less than about 8 centimeters and, preferably, is less than about 3 centimeters. In an even more preferred embodiment, the distance 622 is less than about 2.0 centimeters.

In one embodiment, not shown, envelope 604 is substantially contiguous with filament 602, and the distance between filament 602 and coating 620 is less than about 0.01 centimeters.

The filament 602 is, in many respects, similar to the filament 18 depicted in FIG. 1. This filament, when excited by electrical energy, emits radiant energy at least throughout the entire visible spectrum with wavelengths from about 200 to about 2,000 nanometers at non-uniform levels of radiant energy across the visible spectrum.

It is preferred that filament 602 emit radiant energy in such a manner that in excess of thirty percent of said radiant energy is produced at wavelengths in excess of 700 nanometers. As those skilled in the art are aware, the spectral output of a filament may be measured by a spectral radiometer. Spectral radiometers are well known to those skilled in the art (see, e.g., U.S. Pat. No. 4,280,050, the disclosure of which is incorporated by reference into this specification). For example, Photo Research of 9339 DeSoto Avenue, Chatsworth, Calif., sells model PR-650".

It is preferred that filament 602 emit radiant energy in such a manner that it have a color temperature of at least about 2,800 degrees Kelvin. Means for measuring the color temperature are discussed in another portion of this specification.

It is preferred that the characteristics of coating 620 on lamp envelope 604 be such that, on average, from about 80 to about 90 percent of all of the radiant energy with a wavelength between about 380 and 500 nanometers is transmitted, on average, at least from about 50 to about 60 percent of all of the radiant energy with a wavelength between about 500 and 600 nanometers is transmitted, on average at least about 40 to about 50 percent of all of the radiant energy with a wavelength between about 600 and 700 nanometers is transmitted, and on average at least about 10 to about 20 percent of all of the radiant energy with a wavelength between about 700 and 780 nanometers is transmitted.

Furthermore, it is also preferred that the coating 620 on lamp envelope 604 have reflectance properties such that said coating prevents the transmission of at least about 10 percent of the ultraviolet radiation with a wavelength of from about 300 to about 380 nanometers emitted by said filament. In a more preferred embodiment, at least about 90 percent of such ultraviolet radiation is reflected. It is also preferred that coating 620 prevents the transmission of at least about 20 percent of the ultraviolet radiation with a wavelength of from about 200 to about 300 nanometers emitted by said filament. Preferably, coating 620 will reflect at least about 90 percent of such ultraviolet radiation.

It is also preferred that coating 620 reflects at least about 50 percent of the infrared radiation with a wavelength of from about 780 to about 1,000 nanometers emitted by said filament. In a more preferred embodiment, coating 620 reflectors at least about 90 percent of such infrared radiation.

It is also preferred that coating 620 reflect at least about 25 percent of the infrared radiation with a wavelength of from about 1,000 to about 2,000 nanometers. In a more preferred embodiment, at least about 90 percent of such radiation is reflected.

In general, it is preferred that coating 620 has a reflectance level in substantial accordance with the formula:

$$T(1)=[D(1)-[S^*(1)\times(1-N)]]/[S(1)\times N], \text{ wherein:}$$

T(1) is the transmission of said envelope coating for said wavelength 1 (wavelength is from 380 to 780 nanometers), D(1) is the radiance of said wavelength for the desired daylight, S(1) is the radiance of said filament at said wavelength at normal incidence to said lamp envelope, S*1 is the radiance of said filament at said wavelength at non-normal incidence to said lamp envelope, and N is the percentage of visible spectrum radiant energy directed normally towards said exterior surface of said lamp envelope surface.

In general, coating 620 and lamp envelope 604 has optical properties such that they reflect back to said filament 602 at least thirty percent of all of the radiation emitted by said filament.

As will be apparent to those skilled in the art, the transmission and reflectance values of coating 620 on lamp envelope 604 may be measured by means of a spectrophotometer such as, e.g., the OLIS double-CD Spectrophotometry System, which is sold by the Olis Company of 111 double Bridges Road, Route 2, Jefferson, Ga. 30549.

Figure 20:
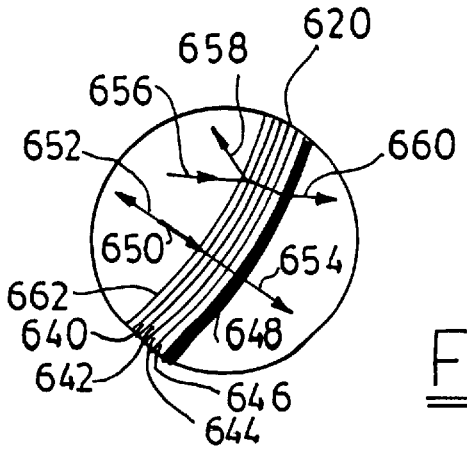
FIG. 20 is a sectional view of the coating used in the lamp of FIG. 19.

FIG. 20 is an enlarged view of a portion of the lamp of FIG. 19, illustrating coating 620. Referring to FIG. 20, it will be seen that, in the preferred embodiment depicted, coating 620 is comprised of substrate 640, first coated layer 642, second coated layer 644, third coated layer 646, and fourth coated layer 648.

In the embodiment depicted in FIG. 20, substrate 640 preferably consists essentially of a transparent material such as, e.g., plastic or glass and has a thickness of from about 0.5 to about 1.0 millimeters. In one preferred embodiment, the substrate material is transparent borosilicate glass. In another embodiment, transparent synthetic fused quartz glass is used as the substrate.

Referring again to FIG. 20, it will be seen that each of coatings 642, 644, 646, and 648 consists essentially of a is a dielectric material (such as magnesium fluoride, silicon oxide, zinc sulfide, and the like) which has an index of refraction which differs from the index of refraction of any other layer adjacent and contiguous to such layer. In general, the indices of refraction of these coatings range from about 1.3 to about 2.6. Each of the layers is deposited sequentially onto the substrate as by vapor deposition or other well know methods.

Referring again to FIG. 20, it will be seen that coating 620 intercepts a multiplicity of light rays (not shown) including normal incident light ray 650. A portion 652 of light ray 650 is reflected; another portion 654 of light ray 650 is transmitted.

Non-normal incident light rays, such as light ray 656, also intersect coating 620. As will be apparent, a portion 658 of this non-normal incident ray is reflected, and another portion 660 of this non-normal incident ray is transmitted. As will be apparent to those skilled in the art, the non-normal incident rays will have more of its red light component transmitted than do the normally incident rays. The formula which applicant has developed, which is discussed in another portion of this specification, takes this difference into account.

With a conventional spectroradiometer, one may measure the optical output for any given lamp system with a specified coating and filament. By knowing the properties of the filament and the coating, and by measuring the spectral output of the lamp, one may calculate the S* and/or the N variables in such equation.

Referring again to FIG. 20, it will be apparent that, in some embodiment, substrate 640 may be designed to absorb ultraviolet radiation which it is desired neither to transmit nor reflect. Such radiation generally will have wavelength of from about 200 to about 380 nanometers; it is preferred to absorb at least about 90 percent of this radiation.

Referring again to FIG. 20, and in the preferred embodiment depicted, an infrared coating 662 is preferably coated on the inside surface of substrate 640.

Figure 21:
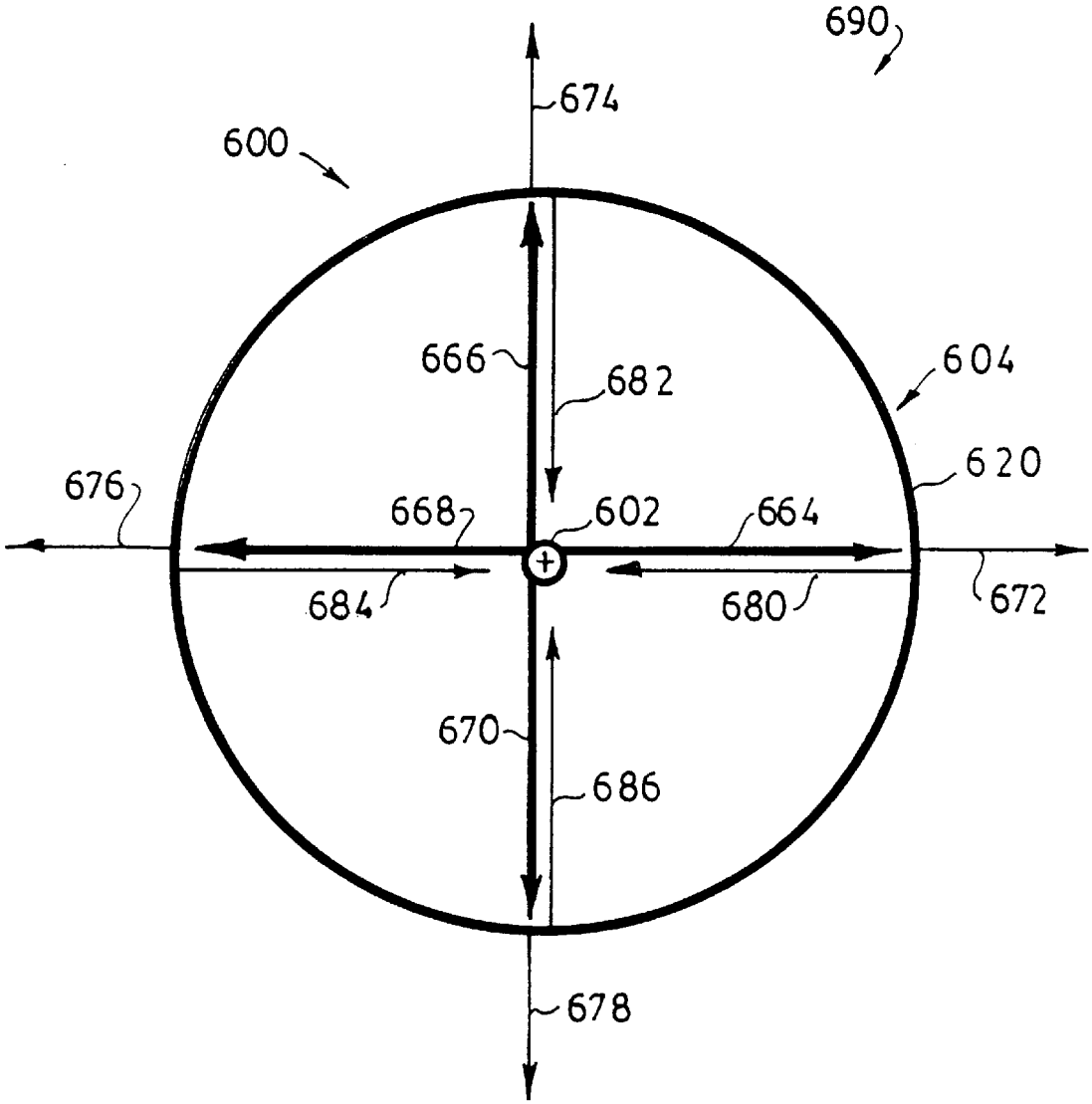
FIG. 21 is a sectional view of another preferred embodiment of the lamp of this invention.

FIG. 21 is a top view of the lamp 600 of FIG. 19. It will be seen that, in the embodiment depicted, light rays 664, 666, 668, and 670 are transmitted from filament 602 in a substantially normally incident fashion; portions 672, 674, 676, and 678 of these light rays are transmitted through coating 620; and portions 680, 682, 684, and 686 of these light rays are reflected from coating 620 back towards filament 602. It be appreciated that, in this embodiment, lamp envelope 604 has a substantially circular cross-sectional shape which, preferably, is used in conjunction with a light-emitting element 602 which produces a substantially point source beam of light. It will also be apparent to those skilled in the art that, regardless of whether one uses an elliptical or spherical shaped lamp envelope 604, the cross-section of such envelope will be substantially circular.

Referring again to FIG. 21, and in the preferred embodiment depicted, it will be seen that lamp 600 is disposed within a directional reflector 690 which tends to reflect rays 672, 674, 676, and 678. In one embodiment, these rays are reflected in a direction substantially parallel to the axis (not shown) of filament 602, which is also substantially perpendicular to the direction of light rays 672, 674, 676, and 678.

As will be apparent, although the coating on reflector 690 may be a conventional one, the light it reflects will have a spectral distribution. substantially identical to daylight. Thus, applicant's novel lamp 600 can be utilized with a multiplicity of standard, low-cost reflector units to produce daylight assemblies. Additionally, the lamp 600 can be utilized with conventional lamp fixtures to provide daylight.

Figure 22:
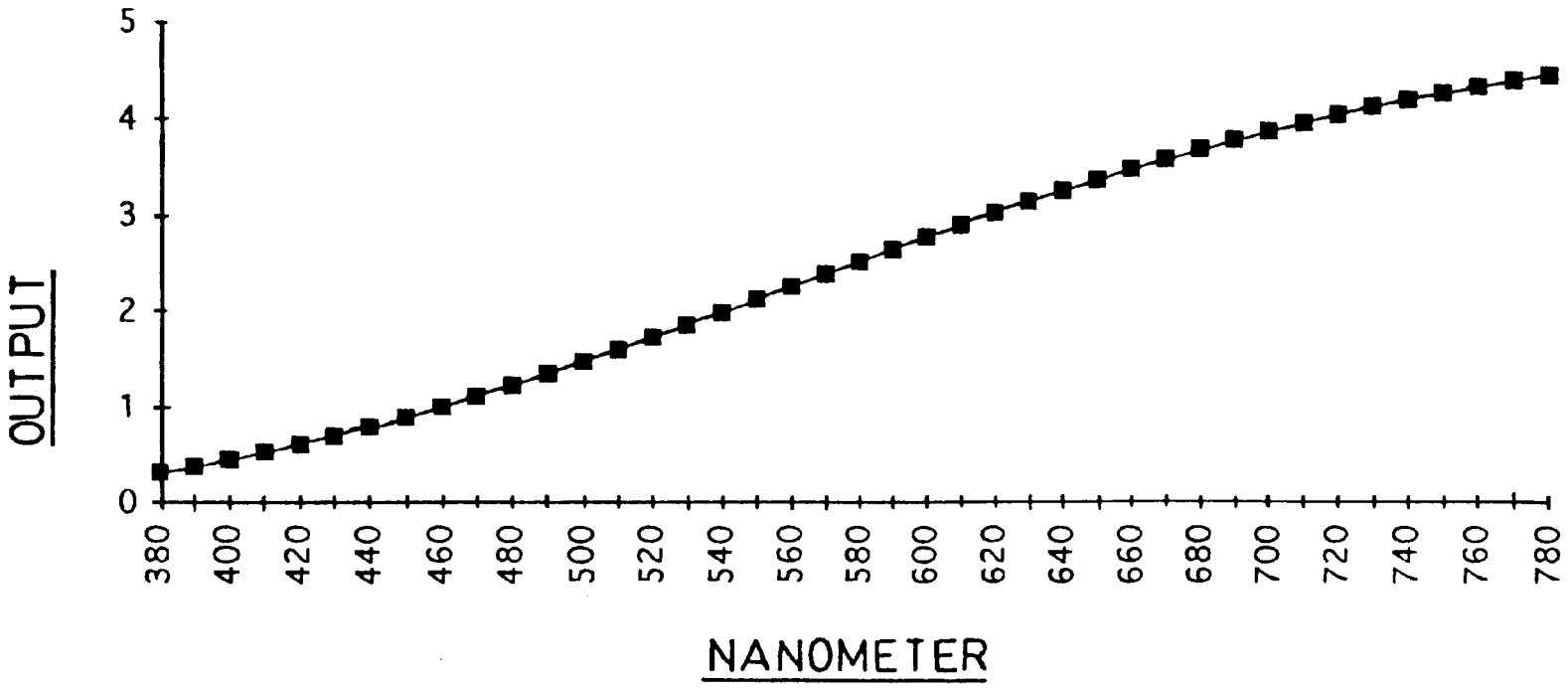
FIG. 22 is graph of the spectral output of the light-emitting element of the lamp of FIG. 19.

FIG. 22 is a graph of the spectral output of a typical filament, such as filament 602, with color temperature of 2,900 degrees Kelvin.

Figure 23:
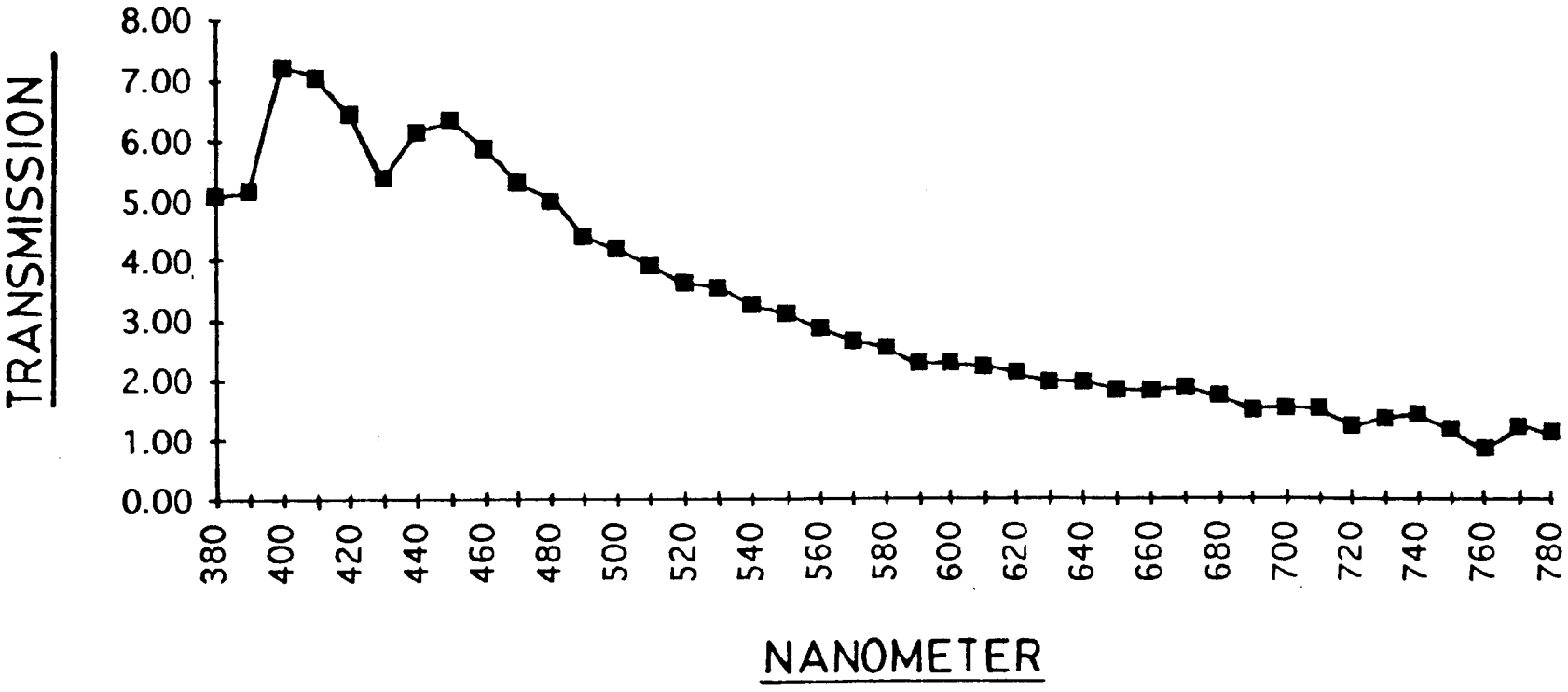
FIG. 23 is a graph of the transmission of the coating of the lamp envelope of the lamp of FIG. 19.

FIG. 23 is a graph of the spectral transmission of the coating 620 of the lamp of FIG. 19.

Figure 24:
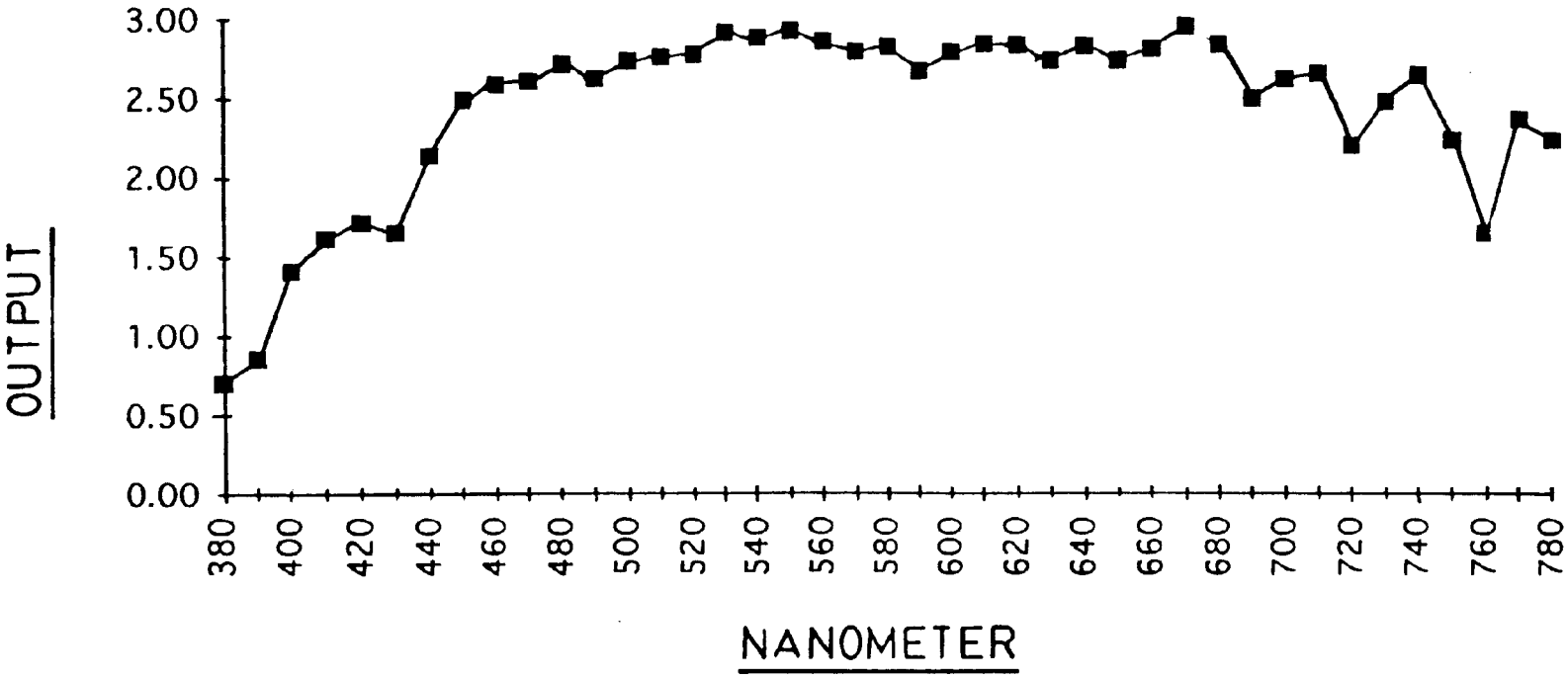
FIG. 24 is a graph of a typical daylight spectrum produced by the lamp of FIG. 19.

FIG. 24 is the spectral output of the rays 672, 674, 676, and 678 et seq. which are produced by combining filament 602, coating 620, and lamp envelope 604 in the precise manner described. As will be apparent to those skilled in the art, the spectral output produced is substantially daylight.

As was discussed elsewhere in the specification, and is apparent to those skilled in the art, as the desired daylight spectra to be produced changes (from, e.g., a a color temperature of 3,500 to 10,000 degrees Kelvin), the properties of the filament 602 and/or the coating 620 905 must also be changed.

Figure 25:
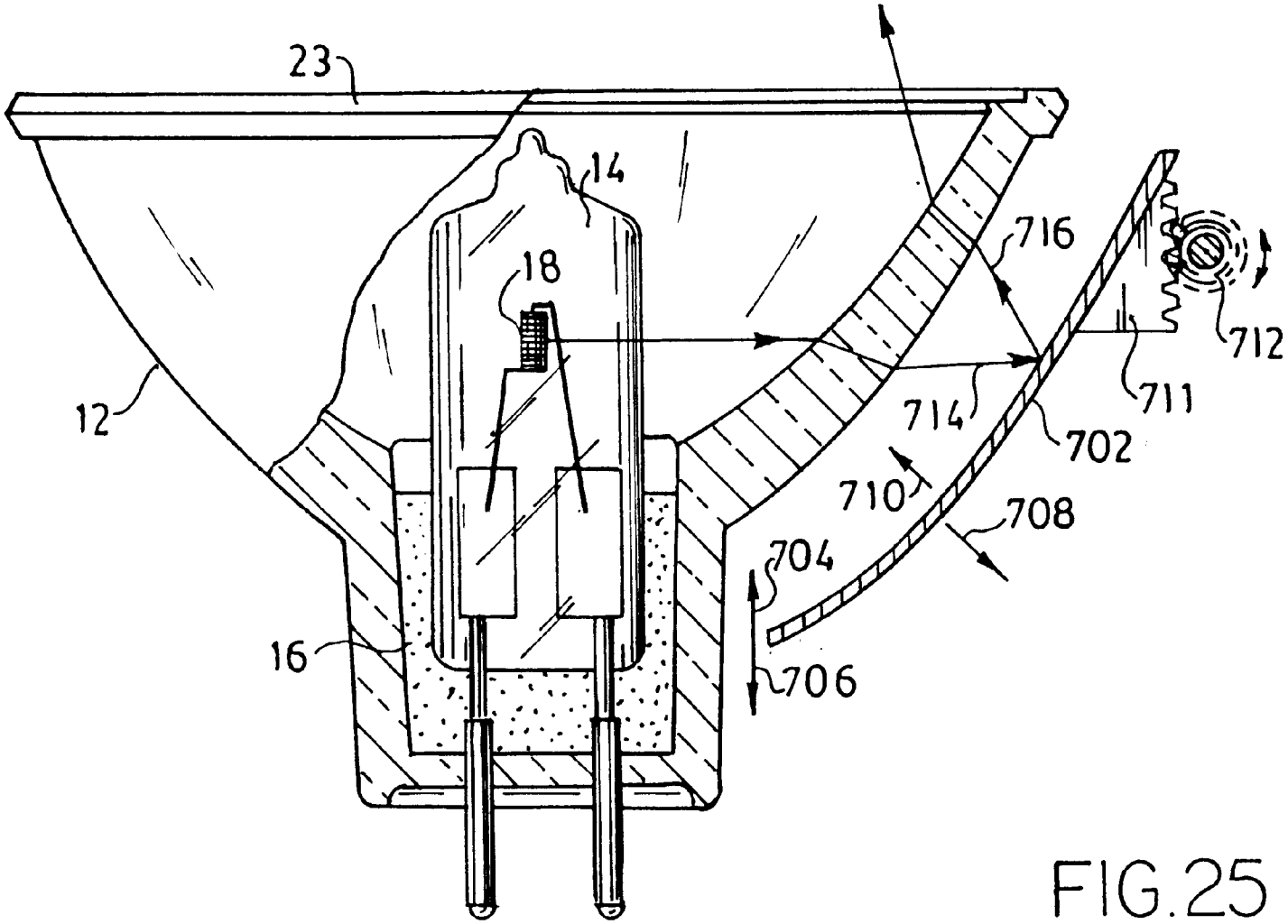
FIG. 25 is a sectional view of another preferred lamp assembly of this invention whose spectral output and irradiance can be varied.

FIG. 25 illustrates a lamp 700 similar to that depicted in FIG. 1 with the exception that the assembly is movably connected to a reflector 702 and with a burner similar to that depicted in FIG. 19. As the reflector 702 is moved in the direction of arrow 704 (up), or 706 (down), or 708 (out) or 710 (in), the color temperature of the spectral output of the lamp, and its irradiance, will be varied.

One may use conventional means to movably connect reflector 702 to lamp 700. Thus, e.g., one may use a worm gear, a friction fit, an electrical stepping motor, etc. In the embodiment depicted in FIG. 25, a ratchet 711 is connected to a gear 712. Other means of adjusting the relative positions of reflector 702 and lamp 700 will be readily apparent to those skilled in the art and also may be used.

In the embodiment depicted in FIG. 25, reflector 702 preferably consists essentially of rigidized aluminum.

As the reflector 702 is moved closer to reflector 12, the rays 714 which normally would escape the system are reflected back towards it (see rays 716) and are incorporated into the spectral output of the system, thereby increasing the foot candles of the output but decreasing its color temperature (because a majority of these rays 714 contain more red light than blue light). The use of the movable reflector 702 allows one to obtain a multiplicity of different spectral outputs.

In one embodiment, cover lens 23 is a diffusse material rather than a clear material. In this embodiment, both the foot candles and the color temperature of the spectral output will be decreased.

Figure 26:
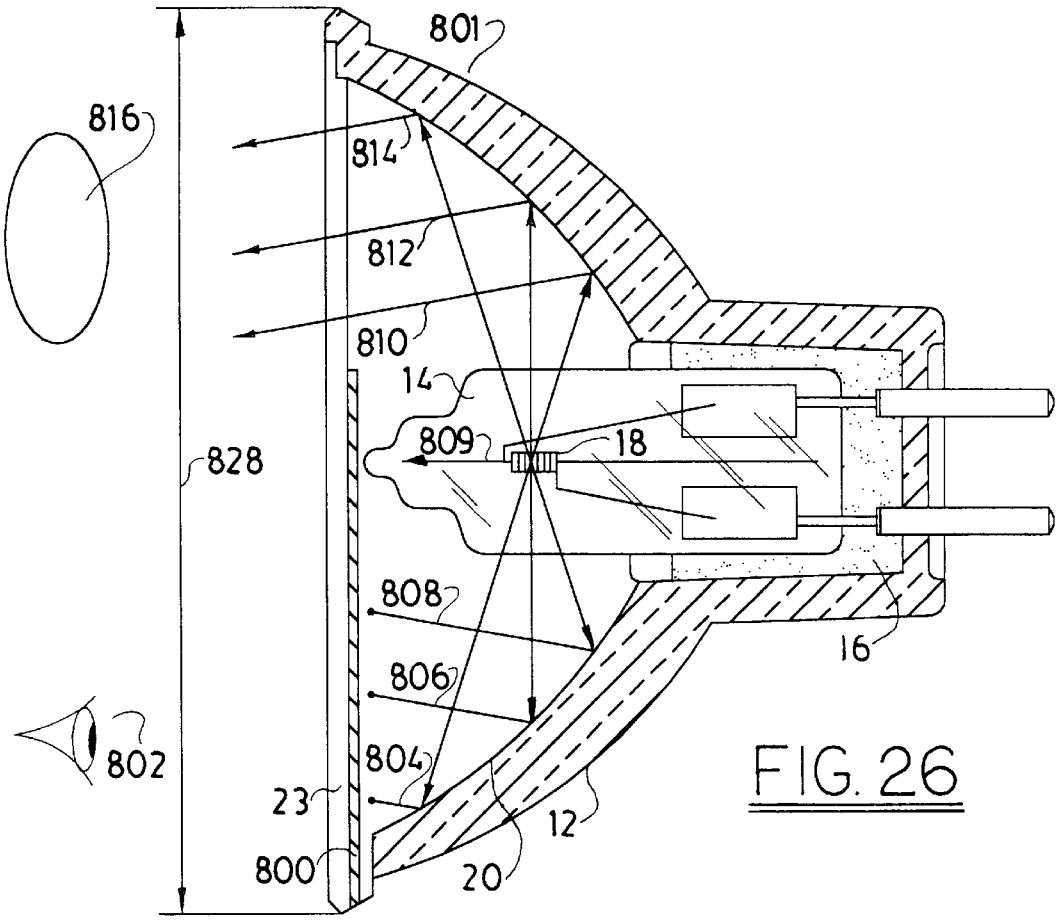
FIG. 26 is a sectional view of one embodiment of an apertured lamp assembly which which contains an opaque aperture.

FIG. 26 is a sectional view of the lamp assembly of FIG. 1 which has been modified by the addition of aperture 800. Referring to FIG. 26, it will be seen that, as viewed from eye 802, rays 804, 806, 808, and 809 will be blocked by aperture 800, whereas rays 810, 812, and 814 will be allowed to escape the lamp. However, because of the placement of eye 802 in the embodiment depicted in FIG. 26, rays 810, 812, and 814 also will not be seen by eye 802.

It will be apparent to those skilled in the art that, were not aperture 800 present in the lamp assembly 801, at least some of the rays produced by the assembly would impact eye 802. However, because of the configuration of aperture 800, and the curvature of surface 20, rays 810, 812, and 814 will preferably form a circular pattern 816.

In the embodiment depicted in FIG. 26, reflector 20 preferably has a parabolic shape with a multi-faceted surface. In another embodiment, not shown, reflector 20 has an elliptical shape. The shape of aperture 800 is shown in more detail in FIG. 27, which is a top view of such aperture.

Aperture assembly 800 preferably is opaque. As used in the specification, the term opaque refers to a substance that is impervious to light and has no luminous trassmittance.

Aperture assembly which are partially opaque and partially transmissive are well known to those skilled in the art. Reference may be had, e.g., to U.S. Pat. Nos. 5,589,906 (aperture with opaque tube), 5,543,870 (aperture with opaque cladding), 5,515,119, 5,506,614 (selective optical elements), 5,448,312, 5,434,413, 5,408,550, 5,391,105, and the like. The disclosure of each of these United States patents is hereby incorporated by reference into this specification.

Referring again to FIG. 27 and in the preferred embodiment depicted therein, it will be seen that aperture assembly 800 is defined by a substantially circular shape 820 which comprises opqaue segment 822 and transparent aperture 824.

The material comprising opaque segment 822 preferably either has an opaque coating and/or consists essentially of an opaque material.

Methods of producing materials with opaque coatings are well known to those skilled in the art. Thus, e.g., one may use opaque, heat-resistant paint sold under the tradename of "KYRLON." Thus, e.g., one may use one or more of the opaque coatings described in U.S. Pat. Nos. 5,573,639, 5,485,536, 5,454,716, 4,726,608, 4,288,713 (lamp having an opaque coating), 4,158,715, 3,993,798, 3,869,305, 3,788, 886, and the like. The entire disclosure of each of these United States patents is hereby incorporated by reference into this specification.

Figure 27:
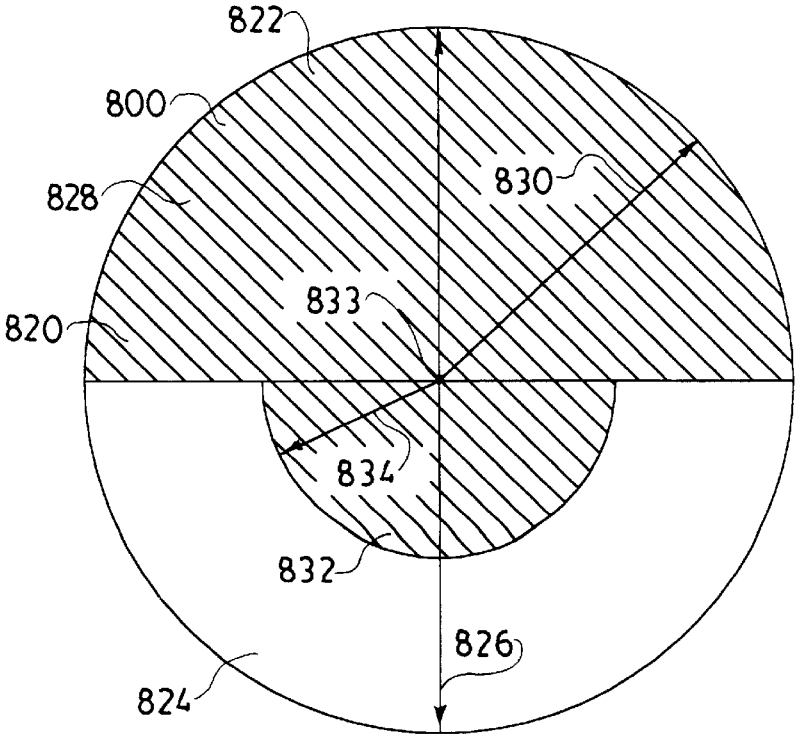
FIG. 27 is a top view of the opaque aperture used in the assembly of FIG. 26.

In the preferred embodiment depicted in FIGS. 26 and 27, segment 822 consists essentially of an optically opaque material such as, e.g., black anodized aluminum. Alternatively, one may use other optically opaque materials such as, e.g., the materials disclosed in U.S. Pat. Nos. 5,613,712 (plastic), 5,473,400 (polymeric), 5,362,653, 4,521,088, and the like. The entire disclosure of each of these United States patents is hereby incorporated by reference into this specification.

Referring again to FIG. 27, the diameter 826 of aperture assembly 800 is preferably at least as large as the clear aperture 828 of lamp assembly 801 (see FIG. 26).

Referring again to FIG. 27, and in the preferred embodiment depicted therein, it will be seen that segment 822 of aperture assembly 800 is comprised of a large semicircle 828 defined by radius 830, and smaller semicircle 832 defined by radius 834 which is preferably integrally connected to larger semicircle 828.

As will be apparent to those skilled in the art, by varying the ratio of radius 834 to radius 830, one will vary the amount of light which can escape the apertures assembly 800. The smaller radius 834 is, the smaller semicircle 832 is. In general, radius 834 is from about 25 to about 75 percent radius 830. Thus, in general, the area of semicircle 832 is from about 0.06 to about 0.56 times as great as the area of semicircle 828. In one embodiment, illustrated in FIGS. 26 through 29, the radii 830 and 834 share a common centerpoint 833.

It will be apparent that one may use aperture assemblies with different shapes and/or dimensions than those depicted in FIG. 27.

Figure 28:
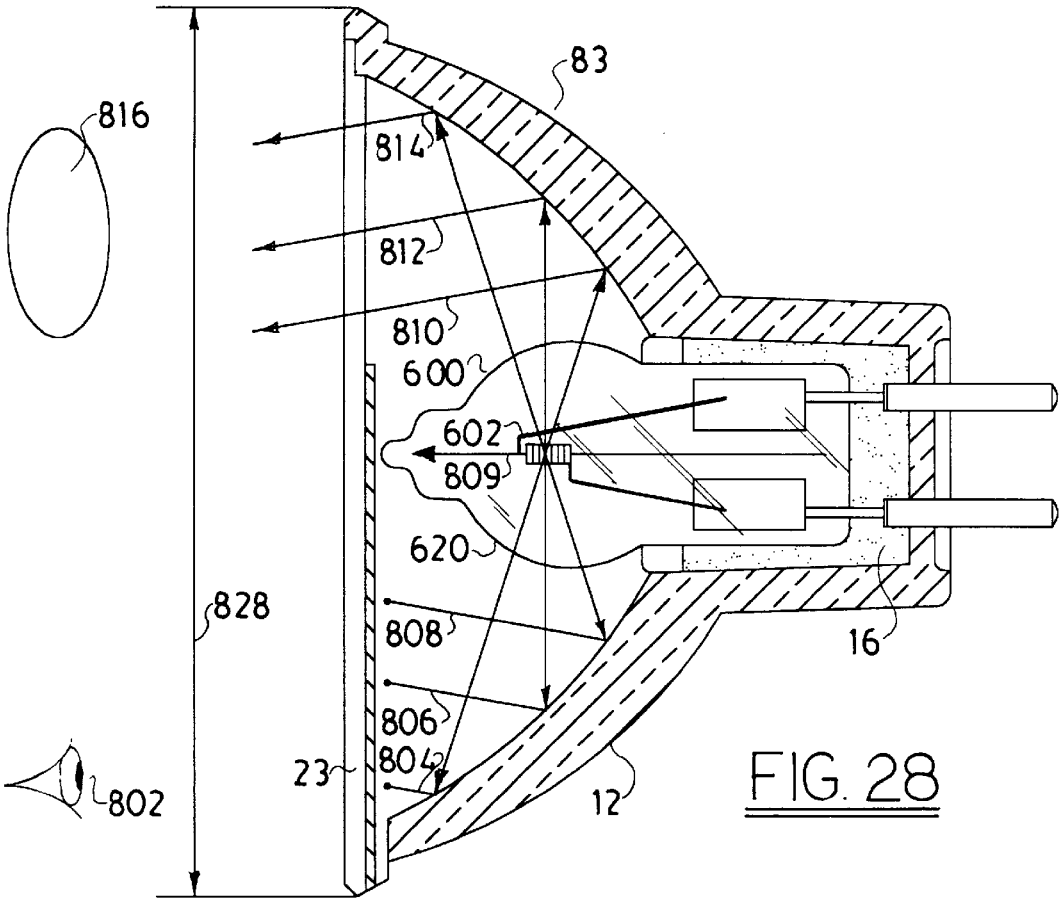
FIG. 28 is a sectional view of another embodiment of an apertured lamp assembly which contains an opaque aperture.
Figure 29:
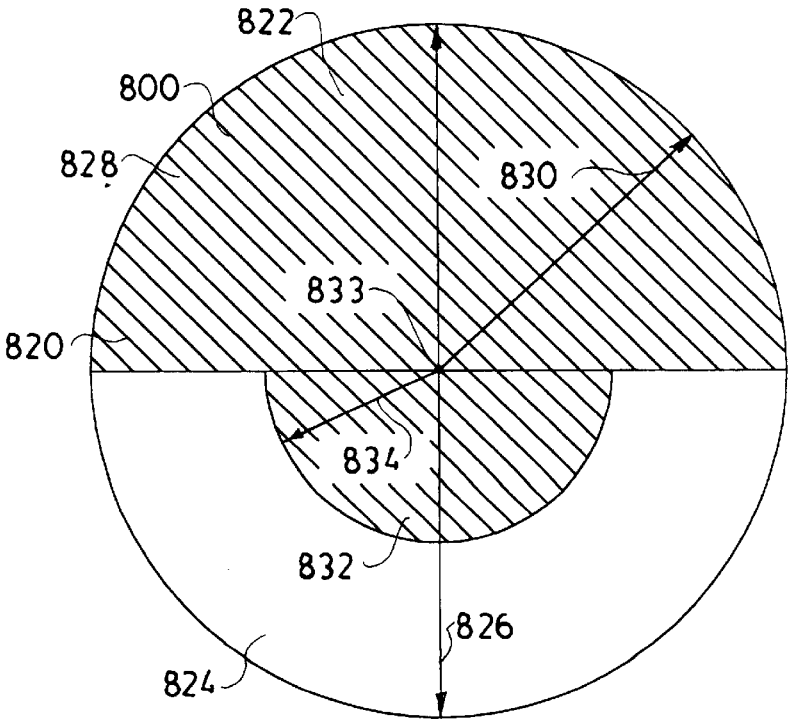
FIG. 29 is a top view of the opaque aperture used in the assembly of FIG. 28.

FIGS. 28 and 29 are comparable to FIGS. 26 and 27 but show the use of aperture assembly 836 with a different lamp assembly 600, of FIG. 19. With that exception, the apertures lamp assemblies depicted in these Figures are identical to the apertured lamp assemblies depicted in FIGS. 26 and 27.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

Thus, in one embodiment (not shown), the aperture assembly 800 can be used with a normal incandescent lamp and, as the ratio of radii 830 and 834 are adjusted, the output of such incandescent lamp can be varied. In a similar manner, when aperture assembly 800 is used with a daylight lamp, its output also may be varied.

I claim:

1. A lamp for producing a spectral light distribution substantially identical in uniformity to the spectral light distribution of a desired daylight with a color temperature of from about 3500 to about 10,000 degrees Kelvin throughout the entire visible light spectrum from about 380 to about 780 nanometers, comprising:

(a) an enclosed lamp envelope having an interior surface and an exterior surface;

(b) a light-producing element substantially centrally disposed within said lamp envelope and which, when excited by electrical energy, emits radiant energy throughout the entire visible spectrum with wavelengths from about 200 to about 2,000 nanometers at non-uniform levels of radiant energy across the visible spectrum;

(c) at least one coating on at least one of said surfaces and having a transmission T(1)in substantial accordance with the formula $T(1)=[D(1)-[S^*(1)\times(1-N)]]/[S(1)\times N]$, wherein T(1) is the transmission of said envelope coating for said wavelength 1 from about 380 to about 780 nanometers, D(1) is the radiance of said wavelength for the desired daylight, S(1) is the radiance of said element at said wavelength at normal incidence to said lamp envelope, s*(1) is the radiance of said element at said wavelength at non-normal incidence to said lamp envelope, and N is the percentage of visible spectrum radiant energy directed normally towards said exterior surface of said lamp envelope;

(d) a reflector disposed around said light producing element; and (e) an aperture assembly disposed in front of said light producing element, wherein said aperture assembly is comprised of an optically opaque material.

2. The lamp as recited in claim 1, wherein said reflector has a parabolic shape.

3. The lamp as recited in claim 1, wherein said reflector has an elliptical shape.

4. The lamp as recited in claim 2, wherein said reflector has a multi-faceted reflective surface.

5. The lamp as recited in claim 1, wherein said aperture assembly is coated with an optically opaque material.

6. The lamp as recited in claim 1, wherein said aperture assembly consists essentially of an optically opaque material.

7. The lamp as recited in claim 6, wherein said optically opaque material is black anodized aluminum.

8. The lamp as recited in claim 1, wherein said aperture assembly is comprised of a first semicircular segment connected to a second semicircular segment.

9. The lamp as recited in claim 8, wherein the radius of said second semicircular segment is from about 0.25 to about 0.75 times as great as the radius of said first semicircular segment.

10. The lamp as recited in claim 9, wherein said first semicircular segment and said second semicircular segment share a common centerpoint.

11. An integral lamp for producing a spectral light distribution which is substantially identical in uniformity to the spectral light distribution of a desired daylight through the entire visible light spectrum from about 400 to about 700 nanometers, comprising:

(a) a filament which, when excited by electrical energy, emits radiant energy at least throughout the entire visible spectrum with wavelengths (1) from about 400 to about 700 nanometers, at non-uniform levels of radiant energy across the visible spectrum;

(b) a reflector body with a surface to intercept and reflect such visible spectrum radiant energy, and said filament is positioned within said reflector so that at least 50 percent of said visible spectrum radiant energy is directed towards said reflector surface;

(c) a filter coating on the surface of said reflector body, with a reflectance level to reflect radiance of every wavelength of the entire said visible spectrum radiant energy directed towards said reflector surface, and which when combined with the radiance of the visible spectrum radiant energy of the filament not directed towards said reflector surface produces a total usable visible light of relatively uniform radiance through every wavelength (1) of the visible spectrum in substantial accordance with the formula $R(1)=[D(1)-[S(1)\times(1-X)]/[S(1)\times X]$, wherein R(1) is the reflectance of the reflector coating for each such wavelength (1), D(1) is the radiance of said wavelength for the desired daylight, S(1) is the total radiance of said filament at said wavelength, and X is the percentage of visible spectrum radiant energy directed normally towards said exterior surface of said lamp envelope; and (d) an aperture assembly disposed in front of said filament, wherein said aperture assembly is comprised of an opaque material.

12. The lamp as recited in claim 11, wherein said reflector has a parabolic shape.

13. The lamp as recited in claim 11, wherein said reflector has an elliptical shape.

14. The lamp as recited in claim 12, wherein said reflector has a multi-faceted reflective surface.

15. The lamp as recited in claim 11, wherein said aperture assembly is coated with an optically opaque material.

16. The lamp as recited in claim 11, wherein said aperture assembly consists essentially of an optically opaque material.

17. The lamp as recited in claim 16, wherein said optically opaque material is black anodized aluminum.

18. The lamp as recited in claim 11, wherein said aperture assembly is comprised of a first semicircular segment connected to a second semicircular segment.

19. The lamp as recited in claim 18, wherein the radius of said second semicircular segment is from about 0.25 to about 0.75 times as great as the radius of said first semicircular segment.

20. The lamp as recited in claim 19, wherein said first semicircular segment and said second semicircular segment share a common centerpoint.

* * * * *